US008769763B2

(12) United States Patent
Kloeppel et al.

(10) Patent No.: US 8,769,763 B2
(45) Date of Patent: Jul. 8, 2014

(54) HIGH PRESSURE EXTRACTOR

(75) Inventors: Gregg M. Kloeppel, Sheffield Lake, OH (US); Mark Ilko, Cleveland, OH (US); Andrew A. Amberik, Streetsboro, OH (US); Allan L. Horst, Dalton, OH (US); Glenn Matusz, Cuyahoga Falls, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 1350 days.

(21) Appl. No.: 11/358,177

(22) Filed: Feb. 21, 2006

(65) Prior Publication Data

US 2006/0185113 A1 Aug. 24, 2006

Related U.S. Application Data

(60) Provisional application No. 60/655,167, filed on Feb. 22, 2005.

(51) Int. Cl.
*A47L 11/30* (2006.01)

(52) U.S. Cl.
USPC ..... 15/320; 15/321; 15/322

(58) Field of Classification Search
USPC ..... 15/320, 321, 322, 319; 34/60
See application file for complete search history.

(56) References Cited

U.S. PATENT DOCUMENTS

| | | | | |
|---|---|---|---|---|
| 3,974,541 | A | | 8/1976 | Silvis |
| 4,046,989 | A | * | 9/1977 | Parise et al. ..... 219/437 |
| 4,109,340 | A | | 8/1978 | Bates |
| 4,327,459 | A | | 5/1982 | Gilbert |
| 4,353,145 | A | | 10/1982 | Woodford |
| 4,580,309 | A | | 4/1986 | Ogden |
| 4,651,380 | A | | 3/1987 | Ogden |
| D293,950 | S | | 1/1988 | Ogden et al. |
| D297,060 | S | | 8/1988 | Kent |
| D297,061 | S | | 8/1988 | Kent |
| 4,845,802 | A | | 7/1989 | Miller et al. |
| 4,934,017 | A | | 6/1990 | Kent |
| 4,949,424 | A | | 8/1990 | Shero |
| 5,287,588 | A | | 2/1994 | Gurstein et al. |
| D345,034 | S | | 3/1994 | Fitzwater |
| 5,371,918 | A | | 12/1994 | Shero |

(Continued)

FOREIGN PATENT DOCUMENTS

| | | |
|---|---|---|
| EP | 1 249 201 A | 10/2002 |
| GB | 2027335 | 2/1980 |

(Continued)

OTHER PUBLICATIONS

International Serach Report dated Oct. 2, 2006.

(Continued)

*Primary Examiner* — Monica Carter
*Assistant Examiner* — Michael Jennings
(74) *Attorney, Agent, or Firm* — Michael Best & Friedrich LLP

(57) ABSTRACT

A floor cleaning device includes a base. A cleaning fluid supply tank is carried by the base. A source of pressure communicates with the cleaning fluid supply tank which pressurizes a cleaning fluid held in the cleaning fluid supply tank to an above atmospheric pressure. A fluid delivery system delivers pressurized cleaning fluid from the cleaning fluid supply tank to a surface to be cleaned.

19 Claims, 22 Drawing Sheets

(56) References Cited

U.S. PATENT DOCUMENTS

| | | | | |
|---|---|---|---|---|
| 5,430,910 | A * | 7/1995 | Wiley | 15/321 |
| 5,455,982 | A | 10/1995 | Armstrong et al. | |
| D364,947 | S | 12/1995 | Kent et al. | |
| 5,473,792 | A | 12/1995 | Kent et al. | |
| 5,500,977 | A | 3/1996 | McAllise et al. | |
| 5,513,415 | A | 5/1996 | Kent et al. | |
| 5,555,595 | A | 9/1996 | Ligman | |
| 5,657,509 | A | 8/1997 | Trautloff et al. | |
| 5,996,175 | A * | 12/1999 | Fusco | 15/410 |
| 6,073,300 | A | 6/2000 | Zahuranec et al. | |
| D431,098 | S | 9/2000 | Saunders et al. | |
| 6,145,159 | A | 11/2000 | Zahuranec et al. | |
| 6,151,748 | A | 11/2000 | Earhart, Jr. et al. | |
| 6,216,313 | B1 | 4/2001 | Leach, II et al. | |
| 6,276,613 | B1 | 8/2001 | Kramer | |
| D460,228 | S | 7/2002 | Zahuranec et al. | |
| 6,418,587 | B1 | 7/2002 | Kent et al. | |
| 6,481,048 | B1 * | 11/2002 | Hauff et al. | 15/321 |
| 6,505,379 | B2 | 1/2003 | Keller | |
| 6,513,188 | B2 * | 2/2003 | Zahuranec et al. | 15/320 |
| 6,560,817 | B2 * | 5/2003 | Deiterman et al. | 15/320 |
| 6,568,024 | B2 | 5/2003 | Kent et al. | |
| 6,571,421 | B1 | 6/2003 | Sham et al. | |
| 6,647,204 | B1 * | 11/2003 | Hutchinson | 392/491 |
| 6,675,437 | B1 * | 1/2004 | York | 15/321 |
| 6,735,811 | B2 * | 5/2004 | Field et al. | 15/320 |
| 6,789,290 | B2 | 9/2004 | Kent et al. | |
| 6,896,742 | B2 * | 5/2005 | Geyer et al. | 134/21 |
| 6,898,820 | B2 * | 5/2005 | Kasper et al. | 15/320 |
| 7,025,084 | B2 * | 4/2006 | Perry et al. | 137/495 |
| 7,093,977 | B2 * | 8/2006 | McCarthy, Jr. | 378/200 |
| 7,105,044 | B2 * | 9/2006 | Konishi et al. | 96/208 |
| 7,198,074 | B2 * | 4/2007 | Lemme et al. | 141/114 |
| 7,270,789 | B1 * | 9/2007 | Astle | 422/522 |
| 7,392,566 | B2 * | 7/2008 | Gordon et al. | 15/319 |
| 7,421,757 | B1 * | 9/2008 | Garcia, Jr. | 15/304 |
| 7,445,015 | B2 * | 11/2008 | Kroeker | 134/140 |
| 7,527,179 | B2 * | 5/2009 | Haimi | 222/401 |
| 7,636,975 | B2 * | 12/2009 | Mah et al. | 15/1.7 |
| 7,752,705 | B2 * | 7/2010 | McDowell et al. | 15/320 |
| 2001/0028239 | A1 * | 10/2001 | Vanderhenst | 323/235 |
| 2001/0039684 | A1 | 11/2001 | Kasper et al. | |
| 2002/0083549 | A1 * | 7/2002 | Deiterman et al. | 15/320 |
| 2002/0148071 | A1 * | 10/2002 | Lee et al. | 15/353 |
| 2003/0024065 | A1 * | 2/2003 | Zahuranec et al. | 15/320 |
| 2003/0041407 | A1 | 3/2003 | Savage | |
| 2003/0159232 | A1 * | 8/2003 | Hekman et al. | 15/320 |
| 2003/0192963 | A1 | 10/2003 | Ebberts | |
| 2003/0217421 | A1 | 11/2003 | Besel | |
| 2004/0083579 | A1 * | 5/2004 | Furr-Britt et al. | 16/421 |
| 2004/0134518 | A1 * | 7/2004 | Kraus et al. | 134/18 |
| 2005/0022333 | A1 * | 2/2005 | McDowell et al. | 15/320 |
| 2005/0246853 | A1 * | 11/2005 | Pierce et al. | 15/320 |
| 2005/0283940 | A1 * | 12/2005 | Hertrick et al. | 15/320 |
| 2006/0085095 | A1 * | 4/2006 | Reindle et al. | 700/258 |
| 2006/0130654 | A1 * | 6/2006 | King et al. | 95/231 |

FOREIGN PATENT DOCUMENTS

| | | |
|---|---|---|
| JP | 11239558 | 9/1999 |
| JP | 2004208874 | 7/2004 |
| WO | WO 03/003897 A3 | 1/2003 |

OTHER PUBLICATIONS

European Search Report for Application No. 11008317.7 dated Jan. 12, 2012 (7 pages).

Office Action from Chinese Patent Office for Application No. 200680005561.4 dated Apr. 6, 2012, 7 pages (including partial translation).

First Office Action from the State Intellectual Property Office of China for Application No. 200680005561.4 dated Sep. 25, 2009 (Original and English Translation—10 pages).

Second Office Action from the State Intellectual Property Office of China for Application No. 200680005561.4 dated Jan. 10, 2011 (Original and English Translation—8 pages).

Japanese Office Action (translation) for Patent Application No. 2007-557076, dated Jan. 17, 2011 (2 pages).

Extended European Search Report for Application No. 10004089.8 dated Jun. 30, 2010 (9 pages).

* cited by examiner

Estimated Power Budget

Air Pump / Heater

| Operating | | 3 Minute Start-up | |
|---|---|---|---|
| Vacuum Motor | 7.0 amps | Vacuum Motor | 0.0 amps |
| Operating Heater 500 watts | 4.2 amps | Operating Heater 1500 watts | 12.5 amps |
| Pressure Pump (air) (cycled) | 0.5 amps | Pressure Pump (air) | 0.5 amps |
| Gear Solenoid | 0.4 amps | Gear Solenoid | 0.0 amps |
| Other (Sensor, LED, Electronic) | 0.4 amps | Other (Sensor, LED, Electronic) | 0.4 amps |
| | 12.5 amps | | 13.4 amps |

FIG. 16

HIGH PRESSURE EXTRACTOR

This application claims the benefit of U.S. Provisional Application Ser. No. 60/655,167, filed Feb. 22, 2005, which is incorporated herein by reference, in its entirety.

BACKGROUND

The present disclosure relates to home cleaning appliances. It finds particular application in conjunction with the cleaning of floors and above-floor surfaces using a cleaning solution.

Portable carpet extractors of the type which apply a cleaning solution to a floor surface and then recover dirty liquid from the surface are widely used for cleaning carpeted and hard surface floors in household settings. Generally, a recovery tank is provided on the extractor for storing the recovered liquid. A vacuum source, such as a vacuum pump, is mounted to a frame of the extractor and applies a vacuum to a nozzle located adjacent the floor surface. For ease of manipulating the extractor, the recovery tank may also be mounted to the base. Carpet extractors of this type are shown, for example, in U.S. Pat. Nos. 6,325,864; 6,378,162; 6,513,188; 6,533,871; 6,536,071; and 6,721,990, the disclosures of which are incorporated herein by reference in their entireties.

Commercial, truck mounted carpet extractors often use steam or high temperature liquids to improve cleaning efficiency. In some commercial extractors, cleaning fluid is delivered under pressure from a delivery nozzle. U.S. Pat. Nos. 3,974,541, 5,400,462, 6,571,421 and 6,898,820 disclose portable systems for cleaning carpets with heated liquids or steam. Despite improvements in portable extractors, the cleaning efficiency and percent solution recovery of portable extractors generally do not match those achieved with the larger, commercial models. Part of the difference in cleaning can be attributed to the ability of the trained operator to optimize the rate of movement of the cleaning wand of the commercial extractor across the floor surface. It would be desirable to provide an improved carpet extractor, which overcomes some of the difficulties encountered by prior art designs, while providing better and more advantageous results.

BRIEF DESCRIPTION

In accordance with one aspect of the present exemplary embodiment, a floor cleaning device includes a base, a cleaning fluid supply tank carried by the base, and a source of pressure communicating with the cleaning fluid supply tank which pressurizes a cleaning fluid held in the cleaning fluid supply tank to an above atmospheric pressure. A fluid delivery system delivers pressurized cleaning fluid from the cleaning fluid supply tank to a surface to be cleaned.

In another aspect, a method of cleaning a surface includes supplying a pressurized gas to a cleaning liquid supply tank and pressurizing a cleaning liquid held in the liquid supply tank. The pressurized cleaning liquid is delivered to a distributor which applies the cleaning liquid to a surface to be cleaned. The cleaning fluid is suctioned from the floor into a recovery tank.

In another aspect, a carpet extractor includes a housing, a cleaning liquid tank mounted to the housing. A fluid delivery system delivers cleaning liquid from the cleaning liquid tank to a surface to be cleaned. A heater heats the cleaning liquid before it exits the fluid delivery system. The heater operates at a first power level in a warm-up phase and at a second power level, lower than the first power level, in an operational mode.

A suction source, carried by the base, operates in the operational mode. A suction nozzle fluidly communicates with the suction source, for withdrawing the cleaning liquid from the surface.

In another aspect, an extractor includes a housing. A cleaning fluid supply tank is carried by the housing, for holding a cleaning fluid. A heater, carried by the housing, heats the cleaning fluid. A fluid delivery system delivers cleaning fluid from the cleaning fluid supply tank to a surface to be cleaned. A suction nozzle withdraws dirty fluid from the surface. A suction source fluidly communicates with the suction nozzle. A control system controls delivery of power to the suction source and the heater. The control system having a warm up mode, in which power is delivered at a first level to the heater and no power is delivered to the suction source, and an operational mode, in which power is delivered at a second, lower, level to the heater, and power is delivered to the suction source.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein:

FIG. 16 is an estimated power budget for the extractor of FIGS. 1 and 11 in start up and operating modes;

DETAILED DESCRIPTION

Figure 1:
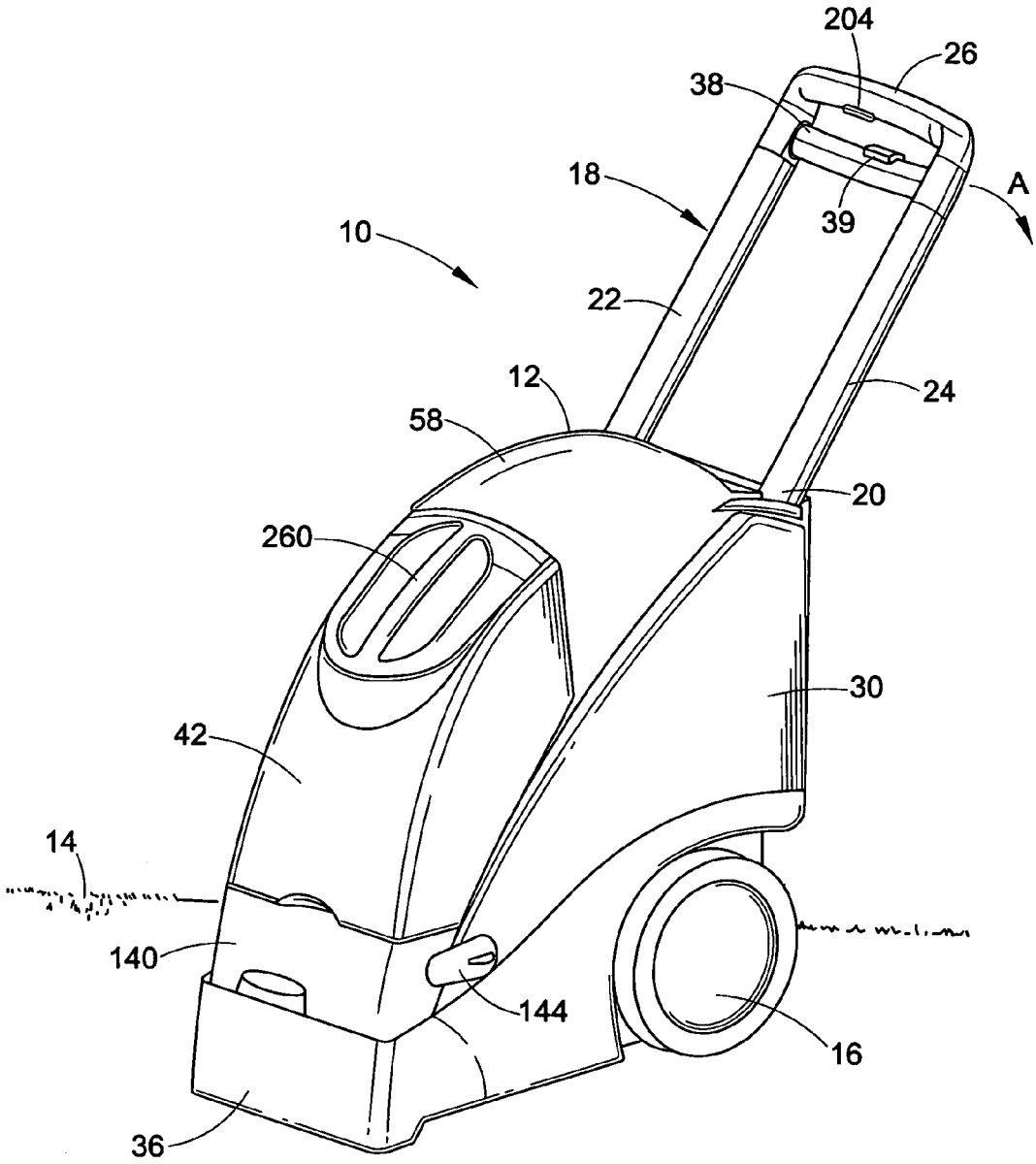
FIG. 1 is a perspective view of a carpet extractor according to a first exemplary embodiment of the present invention.

Referring now to the drawings, wherein the showings are for purposes of illustrating exemplary embodiments of the invention only and are not for purposes of limiting the same, FIG. 1 shows a first embodiment of a floor cleaning device in the form of a carpet extractor 10. The extractor 10 includes a floor engaging portion or base 12 that moves across a floor surface 14, such as a carpet or a hard floor, such as a linoleum or wood floor. Two laterally spaced large rear wheels 16 are journaled to a rear portion of the base 12 for engaging the floor. The illustrated embodiment has no forward wheels, although it is contemplated that the extractor can be provided with such. A directing handle 18 extends rearward and upward from the base 12 for directing the base across the floor surface.

Figure 2:
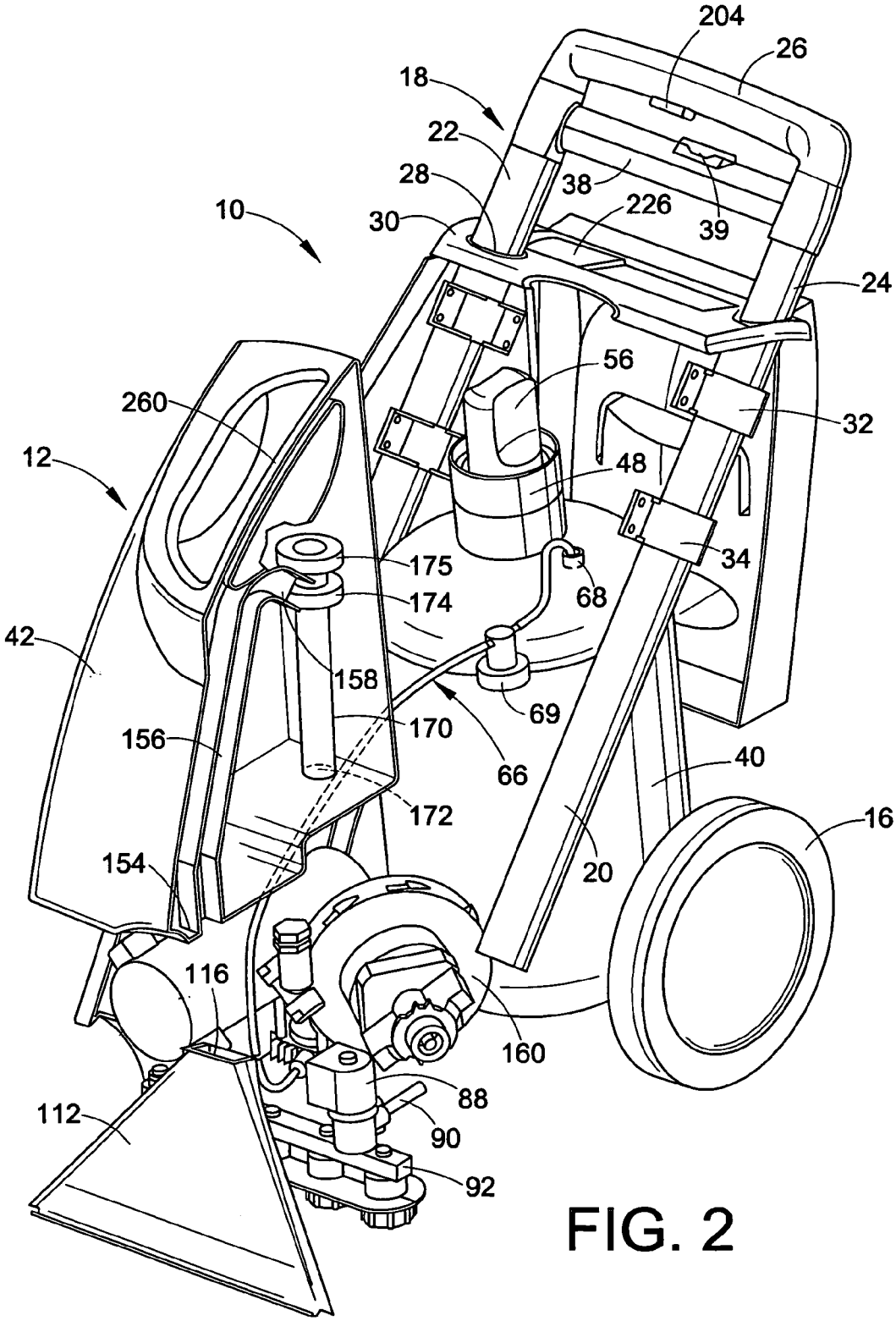
FIG. 2 is an enlarged perspective view in partial section, of the carpet extractor of FIG. 1.

For convenience of the operator, the directing handle 18 can be adjustable in height between a first or operational position, illustrated in FIG. 1, in which a lower end 20 of the handle extends above the base, to a second or retracted position, illustrated in FIG. 2, in which the lower end 20 of the handle 18 is substantially received within the base 12. This allows a user to adjust the handle 18 for height preferences and to retract the handle to reduce the extractor's size for storage. In one embodiment, the handle 18 is generally U-shaped and includes spaced arms 22, 24, which depend from a horizontal bar 26. Ends of the arms 22, 24 are received through suitably positioned apertures 28 in a base housing 30. The arms 22, 24 may be locked in place, relative to the base 12, by a conventional locking mechanism (not shown) to place the bar 26 at different heights between the raised position, illustrated in FIG. 1, and the retracted (lower) position, shown in FIG. 2.

As shown in FIG. 2, the lower ends 20 of the handle arms 22, 24 are guided, during translation, by respective pairs of guide members 32, 34, mounted within the base housing 30, thereby maintaining the same orientation of the handle 18 to the base 12 in all selectable positions. Thus, rather than operating like a conventional upright vacuum cleaner, the fixed orientation of the handle 18, relative to the base, renders the extractor more like a dolly, with the base being tipped upward, at a forward end 36 (FIG. 1), when the handle is rotated downward, in the direction of arrow A. In this embodiment, cleaning thus may take place primarily as the extractor 10 is pulled rearward, rather than in both directions, as in a conventional hinged-type extractor. When moved forwardly, a user tips the forward end 36 up slightly, lifting it off the floor for ease of movement.

In an alternative embodiment, the handle 18 may include telescoping handle portions or other means for adjusting the height of the handle 18 relative to the base 12. In still other embodiments, the lower end 20 the directing handle 18 can be rigidly mounted to the base 12, at a location substantially above the wheels 16. In yet another embodiment, the directing handle can be pivotally connected with the base as disclosed for example, in U.S. Pat. No. 6,145,159, which is incorporated herein by reference in its entirety.

Optionally, a cross member 38 can connect the arms 22, 24 at a location spaced from the lower ends 20. The cross member may provide structural rigidity to the directing handle. A release button 39 on the cross member 38 allows the handle to be selectively moved to one of a plurality of locking positions in the manner of a conventional retractable suitcase handle.

It will be appreciated that the handle 18 can have fewer or more than two arms 22, 24. For example, the handle may be T-shaped, with a single, generally centrally located arm depending from a horizontal bar.

Figure 3:
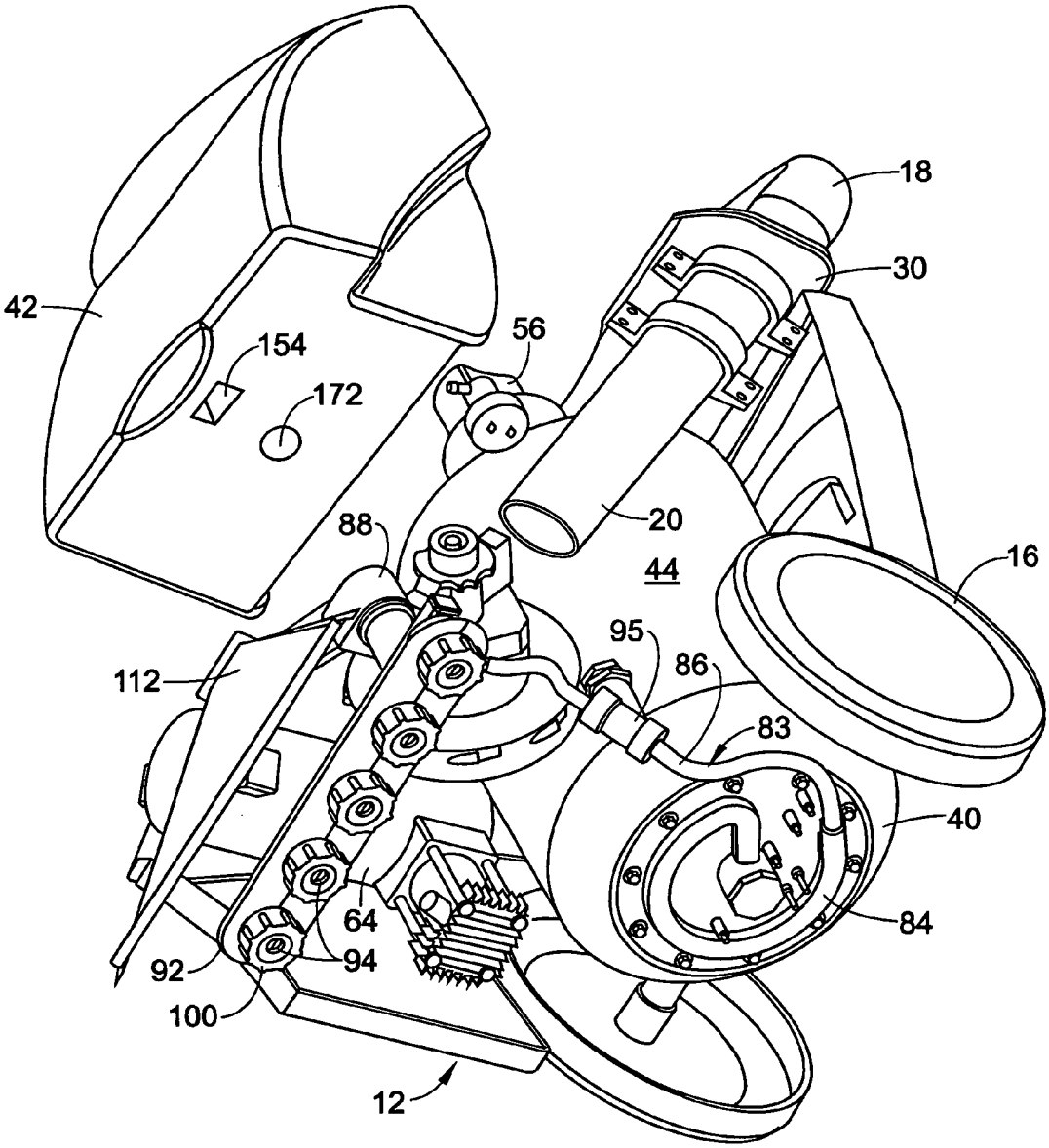
FIG. 3 is an enlarged perspective view, partially cut away, of the base of the carpet extractor of FIG. 1.

With reference now to FIG. 3, the extractor includes a cleaning liquid supply tank 40 and a liquid recovery tank 42, which are both carried by the base 12. However, other locations for one or the other of the tanks are also contemplated, such as on the directing handle 18. In the illustrated embodiment, the liquid supply tank 40 is permanently mounted to the base 12 and the recovery tank 42 is removable. It should be appreciated that one or both of the tanks 40, 42 may alternatively be removable or permanently attached. The supply tank 40 is generally arranged such that its weight and the cleaning liquid contained therein are centered over the wheel axis or closely adjacent thereto. This reduces the physical effort of cleaning for an operator. The illustrated supply tank 40 is a large capacity pressure vessel, which can hold approximately two gallons (about 7.6 liters) of cleaning liquid, such as water or cleaning solution, although other sizes are contemplated.

In this embodiment, the supply tank 40 may be located within the base housing 30 (FIG. 2) and remain fixed on the extractor. The recovery tank 42 can be carried forward of the clean liquid tank 40 and can be removable from the base 12 for emptying. It should be appreciated that the positions of the recovery tank and supply tank may be reversed. Also, the recovery tank 42 can be located on top of or below the supply tank 40. Alternatively, the recovery tank may be mounted rearward or forward of the cleaning liquid supply tank.

Figure 4:
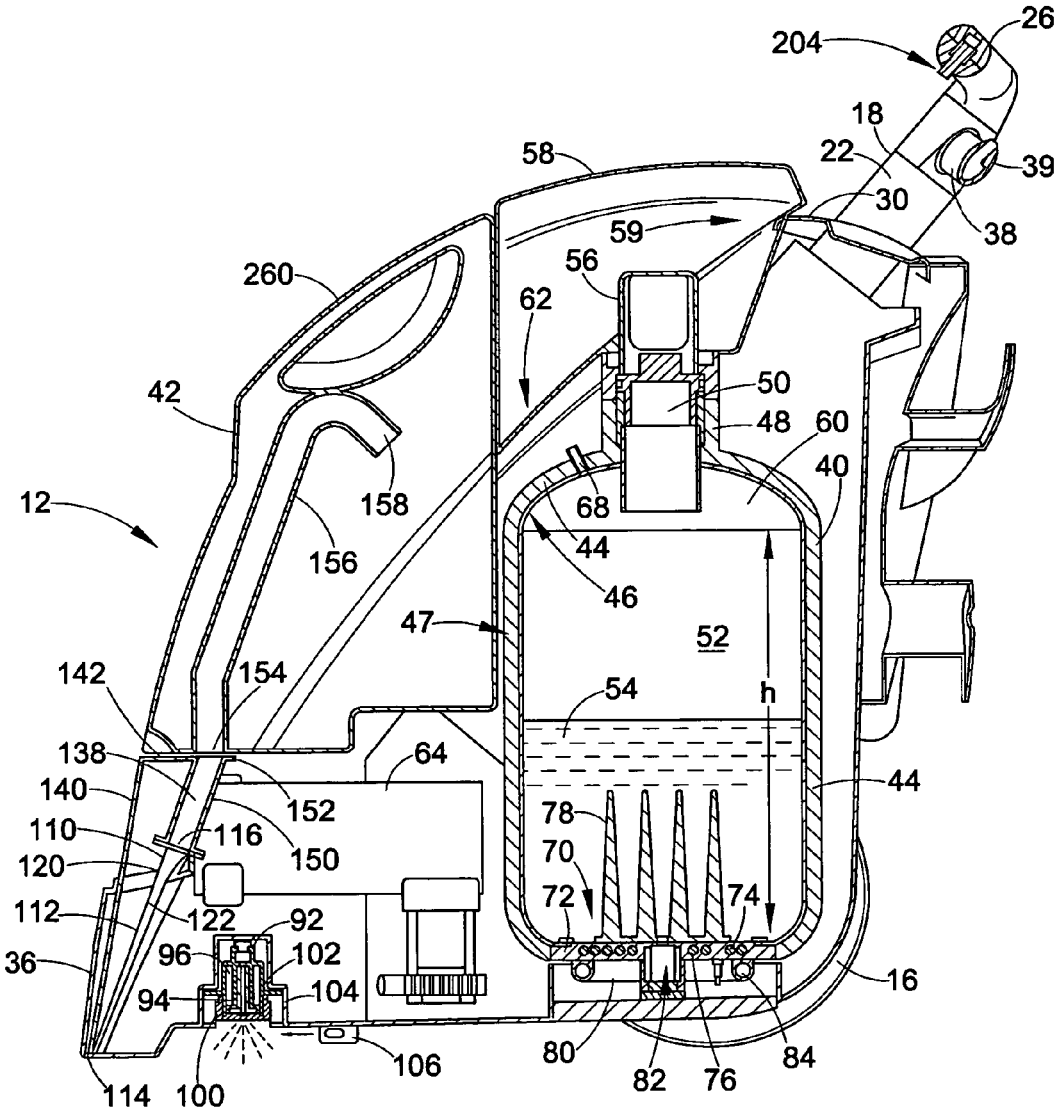
FIG. 4 is an enlarged side sectional view of the carpet extractor of FIG. 1.

With reference now to FIG. 4, in one embodiment, the liquid supply tank 40 includes a side wall 44 comprising a liner 46 and an outer casing 47. An upper end of the side wall 44 defines a liquid inlet in the form of an upwardly extending fill tube 48. The fill tube 48 defines an opening 50, for filling an interior chamber 52 of the tank 40 with a cleaning liquid 54. The opening 50 can be sealed, after filling, with a threaded fill cap 56, which may also serve as a pressure release valve. The fill cap renders the chamber 52 substantially airtight and capable of pressurization at pressures above atmospheric. The fill cap 56 is covered, during operation, by a pivotable cover member 58, which forms an upper portion of the housing 30. The cover member can be pivotally mounted to an upper portion of the housing 30 at pivot points 59 adjacent the handle 18.

The cleaning liquid is initially filled to a height h, leaving a small head space 60 above the liquid. The head space contains air, initially at atmospheric pressure. Prior to floor cleaning, the chamber 52 is pressurized to a pressure of above atmospheric. In one embodiment, the chamber 52 is pressurized to at least about 1.4 $Kg/cm^2$ (about 20 psi), and in another embodiment, to at least about 3.5 $Kg/cm^2$ (about 50 psi). In a further embodiment, the chamber can be pressurized to at least about 5.3 $Kg/cm^2$ (75 psi), all pressures being expressed as above atmospheric. In fact, the pressure can be up to about 50 $Kg/cm^2$ (about 700 psi), although for home use, lower pressures are generally desirable. In one embodiment the internal pressure in the chamber is less than about 17.6 $Kg/cm^2$ (250 psi). For example, the pressure can be from about 5.3 $Kg/cm^2$ to about 10.6 $Kg/cm^2$ (75-150 psi), or about 7.0-9.1 $Kg/cm^2$ (100-130 psi), such as 8.75 $Kg/cm^2$.

With reference again to FIG. 2, a pressure source 64 is connected to the tank 40 for pressurizing the tank by a gas (e.g., air) line 66. The pressure source 64 may include, for example, an air pump, such as a conventional air compressor pump and associated motor, which can operate at relatively low power. The air pump uses air to create a pressure over the liquid in the tank. In one embodiment, the tank is pressurized to the desired pressure in about three minutes, or less. The pressurized air (or other suitable pressurizing gas) enters the tank via a gas fill port 68 located at an upper end of the tank 40. A pressure regulator 69, located in the gas line 66, intermediate the pump 64 and the tank 40, controls the flow of pressurized air applied to the tank 40.

As shown in FIG. 4, the liquid 54 in the supply tank 40 may be heated by a heater 70. In the illustrated embodiment, the heater includes a heating plate 72, which forms a part of the tank wall. As shown, the heating plate 72 can form a base wall of the tank. The heating plate 72 may be removably mounted to the side wall 44 of the tank (as shown), or integral therewith. The heating plate 72 carries heating elements 74, 76, such as resistive heating elements, embedded within it. The heating elements may be independently actuable. Fins 78 extend upward from the plate 72, into the tank interior 52 and conduct heat from the heating plate 72 into the cleaning liquid 54. The fins 78 and heating plate 72 can be formed of a thermally conductive metal, alloy, or other suitable material. Other heating devices are also contemplated, such as an external tank heater or a heat exchanger within or downstream of the tank, or the like.

With reference now to FIG. 3, the supply tank 40 further includes a liquid outlet 80, from which heated, pressurized cleaning liquid exits the supply tank. In the illustrated embodiment, the liquid outlet 80 includes a passage 82, which extends through the heating plate 72 (FIG. 4). A cleaning fluid supply system 83 supplies cleaning fluid from the outlet 80 to the floor surface. The supply system 83 includes a tube 84, which extends from the passage 82, in the form of a partial ring (FIG. 3). The tube 84 may be formed from a thermally conductive metal. The tube 84 can contact or be located closely adjacent the heating plate 72 and thus conduct heat therefrom into the flowing liquid passing through the tube 84. The liquid exiting the supply tank 40 is thus forced past the fins 78, the heating plate 72, and the tube 84 as it leaves the supply tank and be heated thereby.

Figure 5:
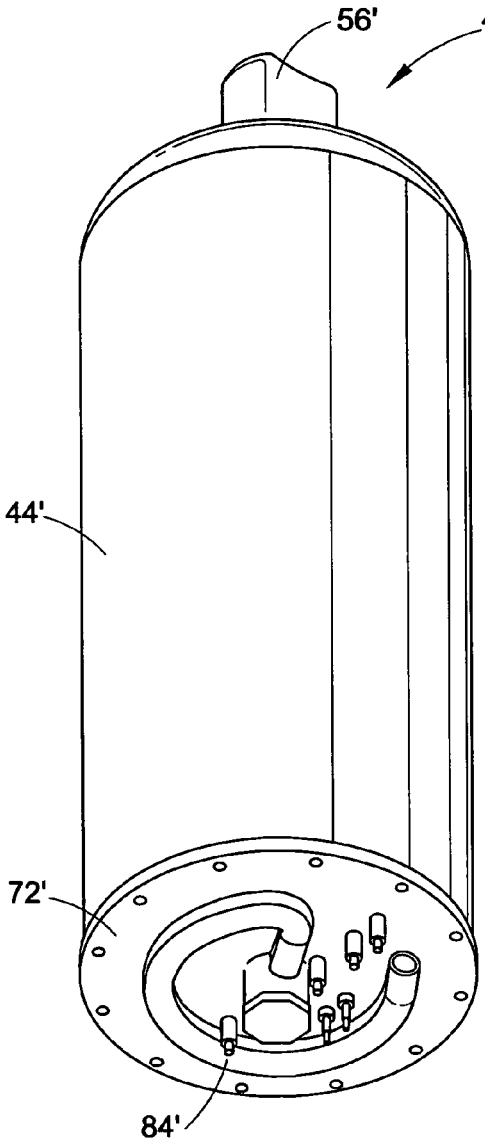
FIG. 5 is a bottom perspective view of an alternative embodiment of a clean liquid supply tank for the extractor of FIG. 1.
Figure 6:
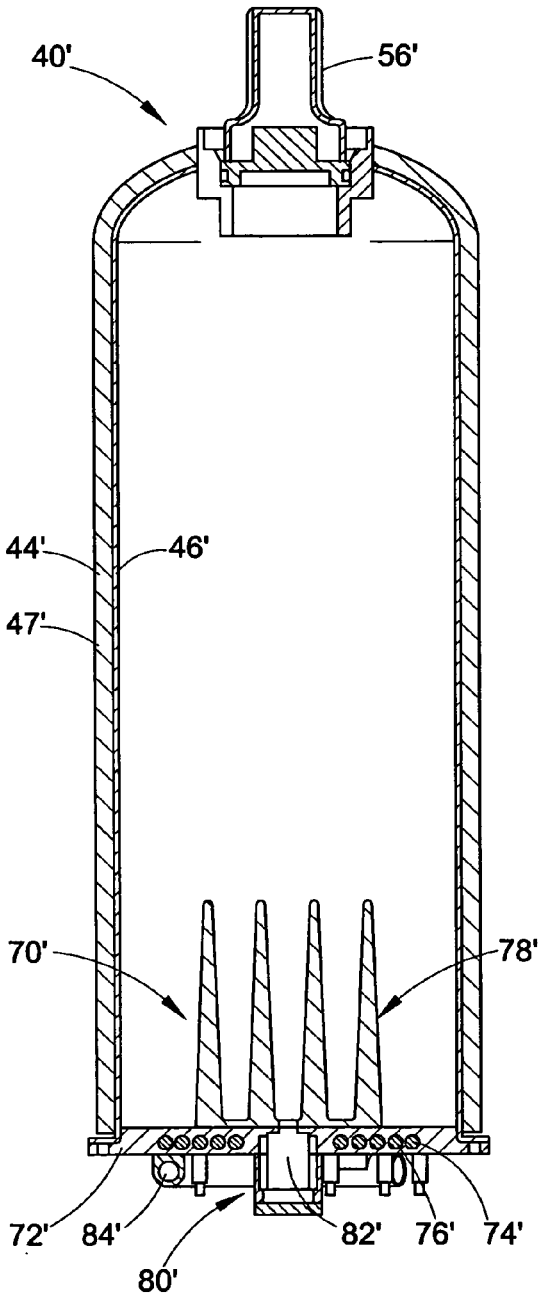
FIG. 6 is a side sectional view of the supply tank of FIG. 5 according to one exemplary embodiment.

FIGS. 5 and 6 show an alternative embodiment of the cleaning fluid supply tank where similar elements are numbered with a primed (') suffix. In the embodiment of FIGS. 5 and 6, the tank 40' has a side wall 44' with a cross section which is substantially the same diameter as a base plate 72'. In the embodiment of FIG. 4, by comparison, the tank side wall 44 is bowed out from the plate 72 allowing a shorter tank 40 to accommodate roughly the same volume of liquid as the tank 40'.

Figure 7:
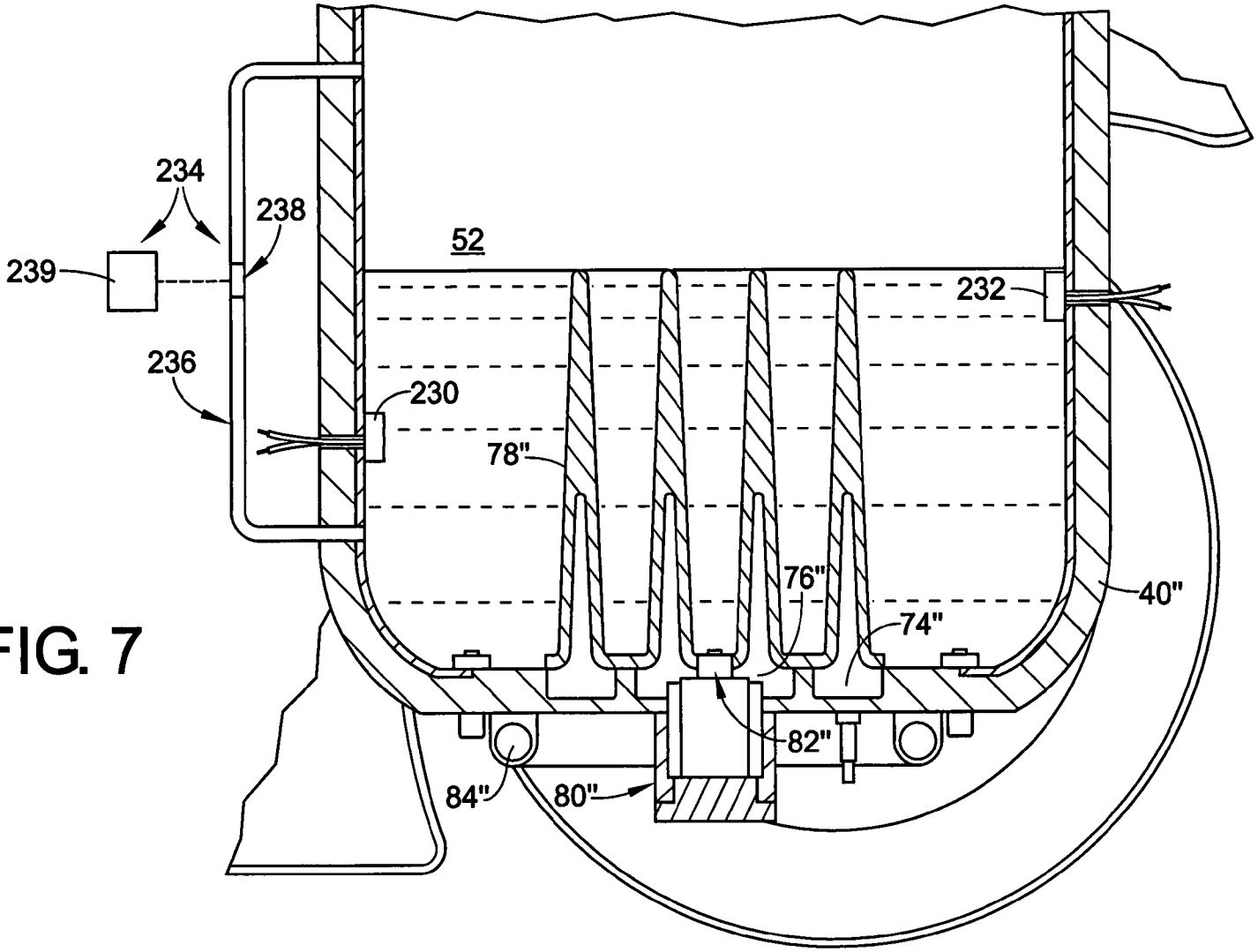
FIG. 7 is a side sectional view of a clean liquid supply tank for the extractor of FIG. 1 according to another exemplary embodiment.

In another alternative embodiment, shown in FIG. 7, where similar elements are labeled with a double primed (") suffix, heating elements 74", 76" extend into the fins 78". Such a design may be advantageous for transferring more heat to the cleaning liquid held in the tank 40".

As shown in FIG. 3, a flexible fluid supply line 86 fluidly connects the tank outlet tube 84 with a selectively actuable valve 88 at an inlet 90 (FIG. 2) of a liquid distributor 92. The distributor 92 includes at least one spray nozzle 94 which releases the cleaning fluid onto the floor surface 14. The fluid line 86 optionally includes a filter 95 which removes particulate matter from the cleaning liquid. Such particulates could clog the spray nozzles 94 or the valve 88.

Figure 8:
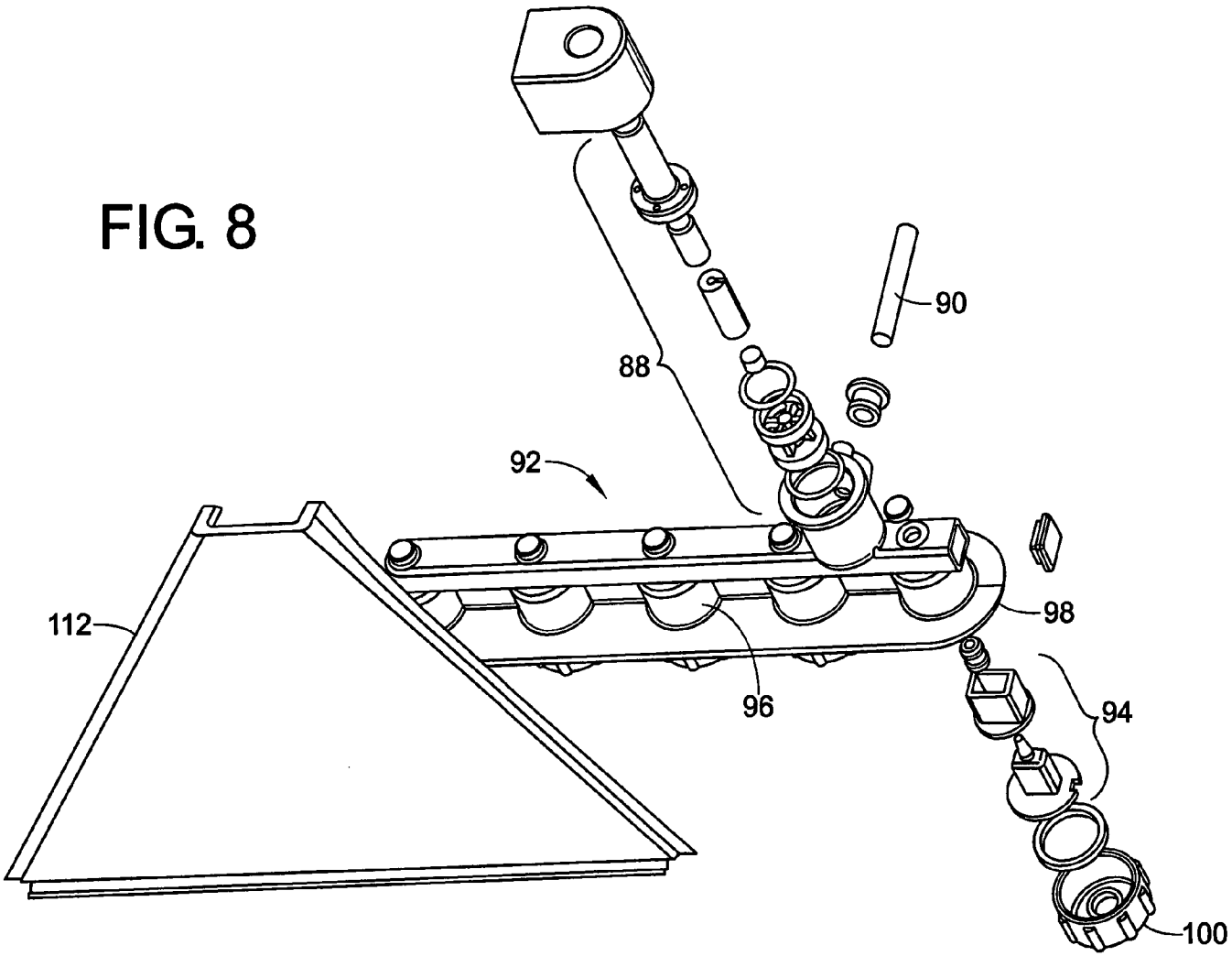
FIG. 8 is an enlarged exploded perspective view of a spray nozzle assembly and suction nozzle of the extractor of FIG. 1.

FIG. 8 shows an exploded view of one embodiment of the distributor 92. This embodiment includes a plurality of spray nozzles 94 (five in the illustrated embodiment; see FIG. 3), only one of which is illustrated in exploded view, by way of example. The spray nozzles may be arranged in a row of about four or five spray nozzles 94, arranged generally perpendicular to the direction of travel of the extractor. Each of the spray nozzles 94 can be removably seated in a cavity 96 of a manifold plate 98. Specifically, each spray nozzle 94 is held in place by a threaded cap 100, which engages corresponding threads of a fitting 102 on the manifold plate lower surface (FIG. 4). The spray nozzles 94 are all positioned in a downwardly facing socket 104 of the base housing 30 (FIG. 4). The cleaning liquid 54 may be applied in the form of a spray of liquid, a mist, or a vapor, particularly if the liquid is above its boiling point. In an exemplary embodiment, where the liquid is heated to about 65-95° C. (e.g., 75-85° C.), at a pressure of 7.0-9.1 $Kg/cm^2$ (100-130 psi), the drop in pressure as the liquid exits the nozzles 94 causes the heated liquid to vaporize. The socket 104 contains much of the vapor and directs it toward the floor surface.

Optionally, the cleaning fluid vapor or spray emitted from the nozzles 94 is illuminated by a light 106 (FIG. 4), which assists the operator in seeing the location of the vapor/spray. As shown in FIG. 8, the nozzles 94 can be removed from the distributor for cleaning or maintenance.

Figure 9:
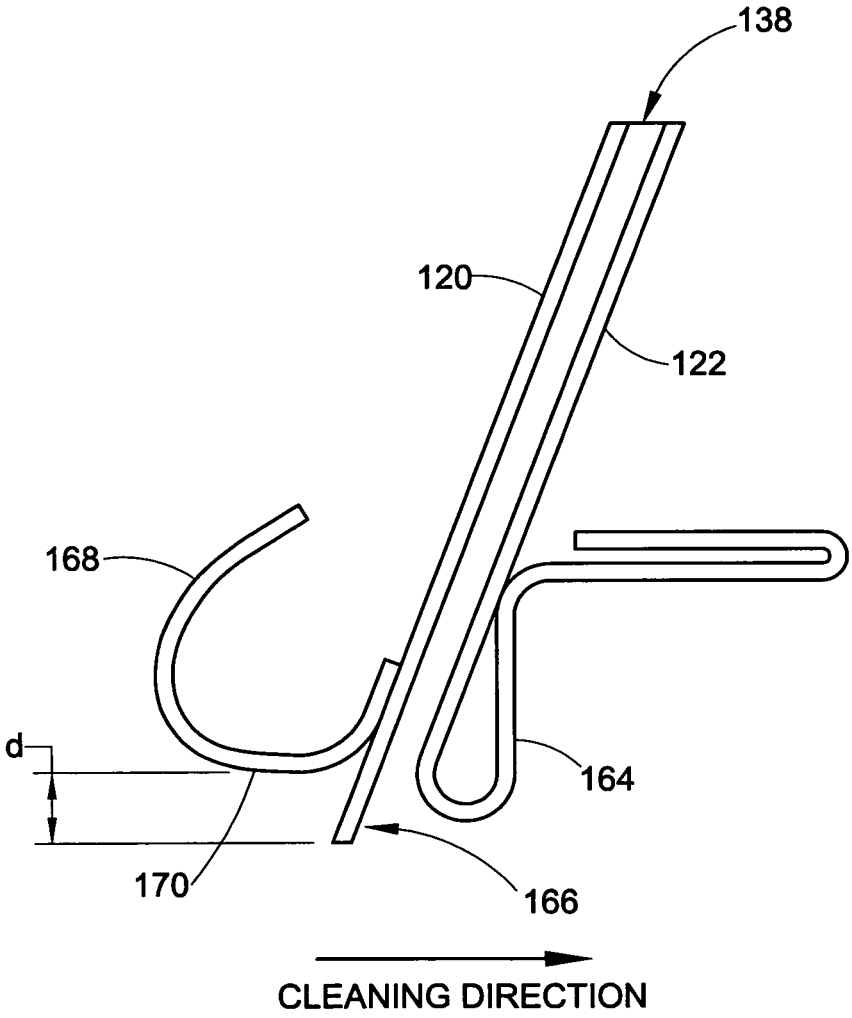
FIG. 9 is an enlarged side sectional view of the of the tip of a suction nozzle of the extractor of FIG. 1.

As shown in FIG. 4, a fluid recovery system 110 withdraws dirty cleaning fluid from the floor and delivers it, along with working air, to the recovery tank 42. The fluid recovery system 110 includes a suction nozzle 112 which defines a fluid inlet 114 and a fluid outlet 116. The illustrated suction nozzle 112 is located at the forward end 36 of the base. To maximize the time of contact of the cleaning liquid with the floor, the suction nozzle 112 is spaced forwardly of the distributor 92. The suction nozzle 112 can be triangular in shape with the inlet 114 at a lower end, adjacent the floor, and extending laterally across the base. As shown in FIG. 9, the suction nozzle 112 includes front and rear laterally extending plates 120, 122, which define a portion of a fluid recovery passage 138 therebetween. The passage 138 extends from the inlet 114 to the recovery tank 42 and carries the recovered cleaning liquid and air to the recovery tank. The suction nozzle 112 is covered, during floor cleaning, by a removable or movable front panel 140 of the base housing 30. A cover 144 can be removed or pivoted to provide access to a tool port. Removing the cover 144 allows the insertion of a suction hose for an above-floor cleaning tool.

The base housing 30 defines a socket 142, above the front panel 140, which receives the recovery tank 42 therein.

With reference again to FIG. 4, the suction nozzle 112 is fluidly connected to the recovery tank 42 by a suction pipe 150. The suction pipe has a fitting 152 at its open end which sealingly engages an inlet 154 on the lower end of the recovery tank, through which the recovered fluid enters the recovery tank. In one embodiment, the suction pipe 150 can be removed for installing a suction hose of an above floor tool (not shown). The recovery tank 42 includes an inlet pipe 156, which extends into the tank 42 from the inlet 154 and which has an outlet 158 at its upper end.

With reference again to FIG. 2, the fluid recovery system 110 further includes a suction source 160, such as a fan/motor, which is fluidly connected with the recovery tank 42 and applies suction to the nozzle 112 and/or the recovery tank to draw working air and recovered cleaning liquid from the carpet into the recovery tank via the passage 138. The fan/motor 160 may be supported within the base housing 30, or located elsewhere on the extractor. The fan/motor may run constantly in the operating mode (i.e., when the extractor 10 travels in both cleaning and non cleaning directions), or may be controlled to operate only in the cleaning (reverse) direction. In one embodiment, the fan/motor 160 does not operate during a warm-up period.

With reference again to FIG. 9, a lower end 164 of the rear plate 122 of the suction nozzle 112 is rolled outwardly to define a U-shaped lip, which slides smoothly across the carpet surface. The front plate 120 has a sharp edge 166 extending along its lower end, which serves a function similar to a squeegee in encouraging liquid pickup when the extractor is moved in a rearward direction. The edge 166 penetrates the carpet tufts by a predetermined distance that is governed by a curved, laterally extending U-shaped flange 168, which extends forwardly of the plate 120. A lower end 170 of the flange is upwardly spaced from the edge 166 by a distance d which can be on the order of about 0.5-1.5 cm. The flange 168 slides across the top surface of the carpet, maintaining the edge 166 slightly below the surface. It will be appreciated that when the extractor is pulled in the cleaning direction (i.e., generally rearward), the front plate 120 is rearward of the rear plate 122, in the direction of travel. The plates 120, 122 and flange 168 may be formed from a rigid material, such as plastic or stainless steel. The nozzle configuration, in combination with the suction source, can provide a vacuum lift of about 90-205" (229-308 cm) water, 95-105" (321-267 cm) water, which is about double that of conventional carpet extractors suitable for home use.

Because of the sharp edge 166, and because the extractor is mounted on only a single axle located near its rear end, the carpet extractor does not travel as readily in the forward direction. Therefore, the user should tip the extractor up when manipulating the extractor in the forward direction. This lifts the front end 36 of the extractor from the floor 14 for forward movement.

Figure 10:
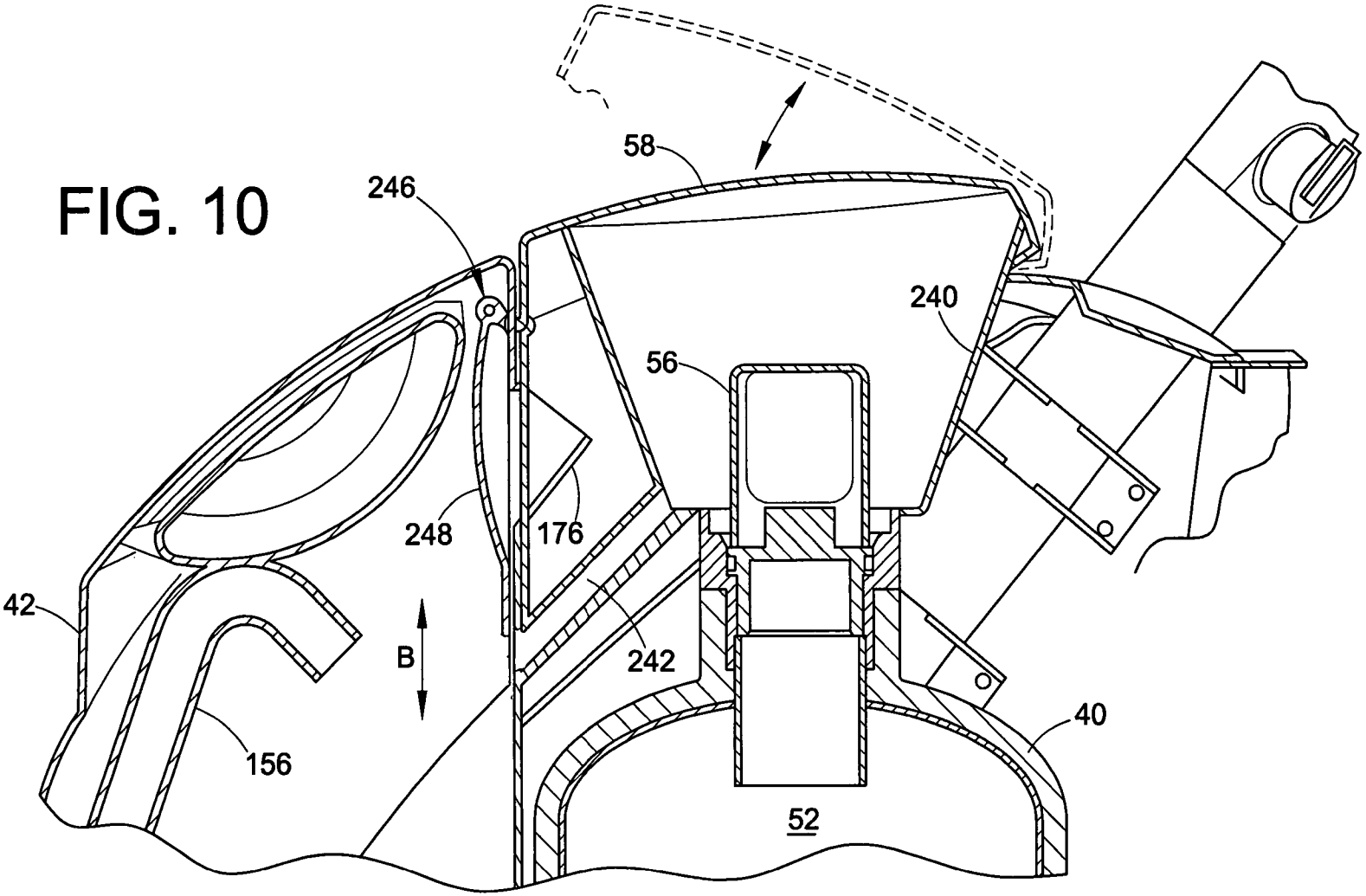
FIG. 10 is an enlarged side sectional view of an upper end of the base of the carpet extractor of FIG. 1 according to another exemplary embodiment.

With reference once more to FIG. 2, the recovery tank 42 includes a standpipe 170 which has an outlet 172 in a lower wall of the recovery tank. When the recovery tank 42 is installed on the base, the standpipe is automatically connected with the suction motor/fan 160 for withdrawing air from the recovery tank. An annular float 174 is carried by the standpipe 170 and closes off an upper open end 175 of the standpipe when the liquid in the recovery tank reaches a predetermined level. As best shown in FIG. 10, the recovery tank defines a pour spout 176 for ease of empting. The pour spout 176 is sealed from the atmosphere, during suctioning, by the lid 58.

Figure 11:
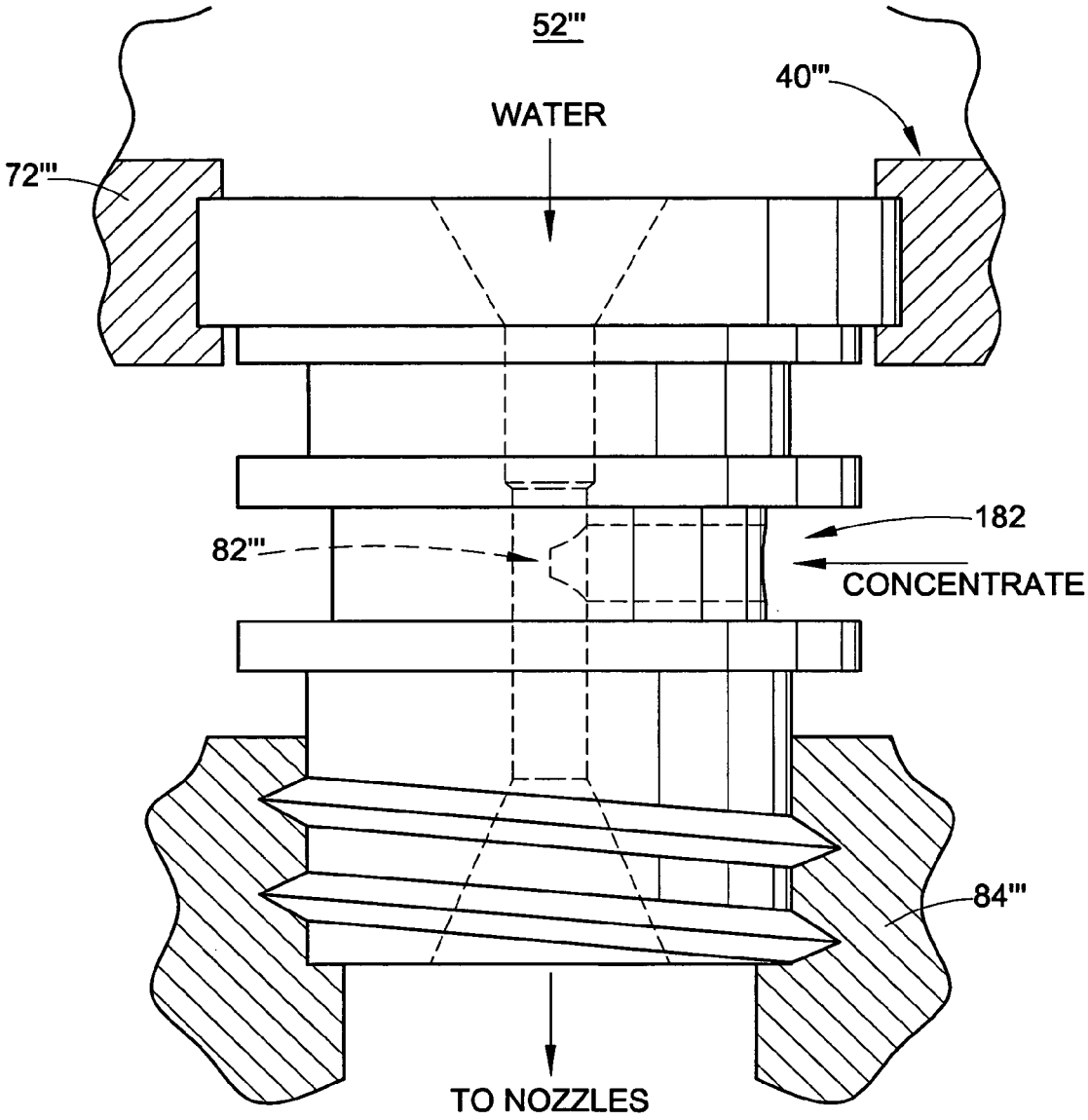
FIG. 11 is an enlarged side view of a lower end of a clean liquid supply tank illustrating a venturi nozzle according to another alternate embodiment.

With reference now to FIG. 11, a lower end of an alternate embodiment of a cleaning liquid tank 40", which may be utilized in the carpet extractor of FIG. 1, is shown where similar elements are indicated by a triple primed (''') suffix and new elements are accorded new numerals.

In this embodiment, a second cleaning liquid tank 180 (FIG. 12) communicates with a cleaning liquid tank via a passage 82''' downstream of the outlet. The second cleaning liquid tank 180 may be permanently affixed to the base or removable therefrom. It may also hold a supply of a cleaning liquid concentrate. The main tank 40''' can hold water without any cleaning additives in this embodiment. The cleaning liquid concentrate may be drawn into the outlet 82''' by a venturi orifice 182 and mix with pressurized water from the tank 40'''. The venturi nozzle 182 draws the cleaning liquid concentrate (e.g., soap) at a controlled rate from the supply tank 180 to form a cleaning solution before passing out of the spray nozzles 94.

Figure 12:
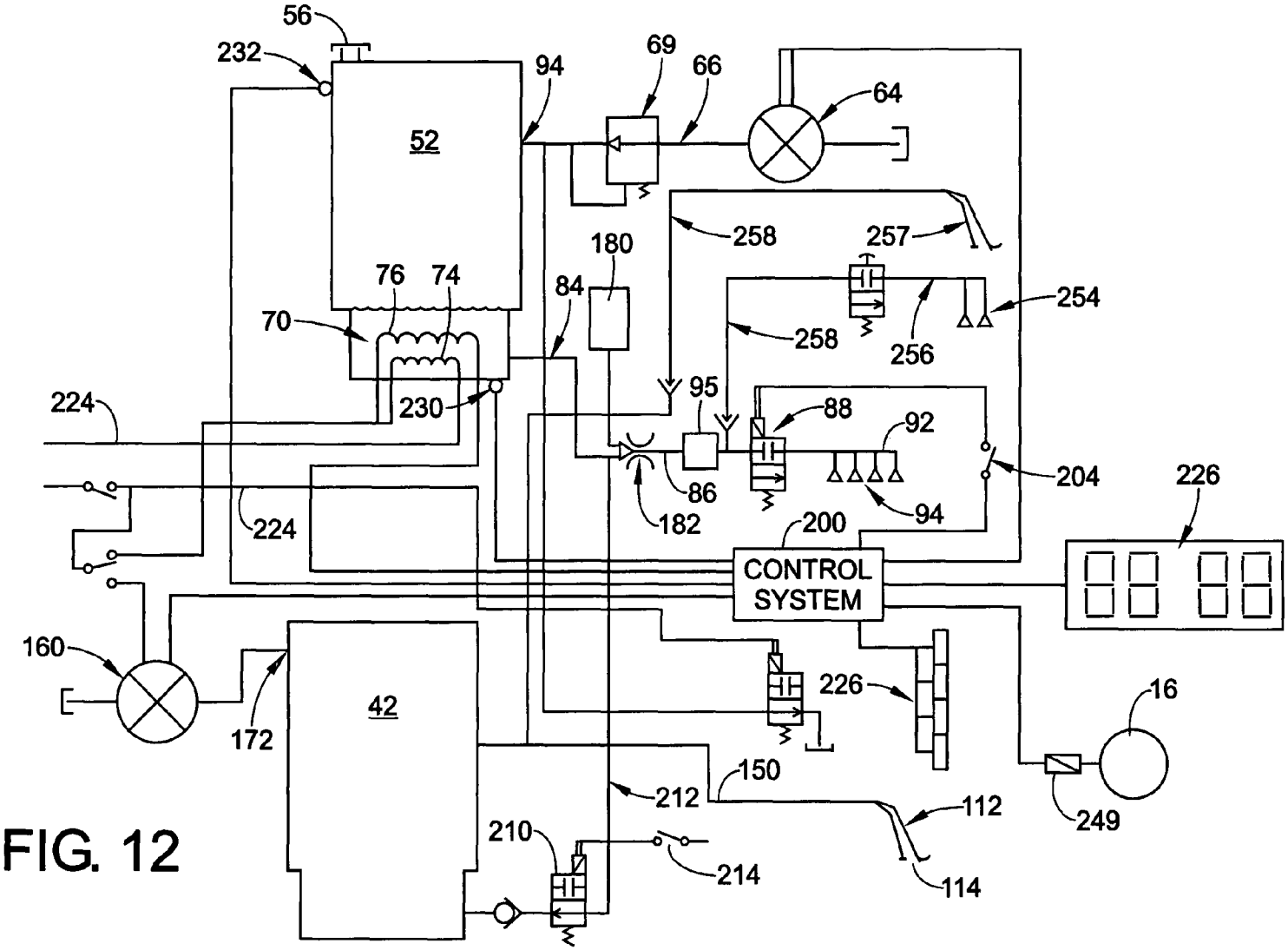
FIG. 12 is a schematic view of the fluid delivery and recovery system of the extractor of FIG. 11.

With reference to FIG. 12, it shows schematically the liquid supply system 83 and the recovery system 110 of the extractor of FIG. 1, with the second cleaning liquid tank 180 of FIG. 11. In this embodiment, the outlet tube 84 of the supply tank 40 is connected with the distributor 92 and spray nozzles 94 by the fluid line 86. The cleaning fluid in the line 86 may have a flow rate above 500 ml/min, (e.g., at least about 1200 ml/min), and up to about 2000 ml/min. In one embodiment, the flow rate is about 1300-1700 ml/min. For example, at a tank pressure of about 7.0 $Kg/cm^2$ (100 psi), the liquid exits each of the nozzles 94 at about 325 ml/min (i.e., a total of 1300 ml/min for four nozzles; or, 260 ml/min. for five nozzles).

The valve 88 in the fluid line 86 selectively closes the tank 40 from the downstream end of the fluid distribution system to prevent flow from the tank 40 to the spray nozzles 94. In the illustrated embodiment, the valve 88 is located at the inlet to the distributor 92. However, it is also contemplated that the valve 88 may be located intermediate the tank outlet tube 84 and the spray nozzles, or in the outlet tube 84, or closely spaced therefrom. The valve 88 may be a known solenoid valve which is under the control of a control system 200. The control system 200 can include a conventional microprocessor. In one embodiment, the valve 88 is actuated by an on/off switch 204, located on the extractor handle 18 (FIG. 1), which communicates with the control system 200.

The operator may be advised to use the spray selectively (e.g., only when pulling the extractor rearward). In another embodiment (not shown), the valve 88 is actuated to fluidly connect the tank 40 with the distributor 92, only when the carpet extractor is being moved in a rearward direction (i.e., when being pulled by an operator). When the extractor is moving in a forward direction (i.e., being pushed by the operator), the valve is in a closed position and cleaning liquid is not released from the distributor. To this end, the control system 200 communicates with a sensor (not shown), which detects whether the wheels 16 are rotating clockwise or counterclockwise. For example, the sensor may be coupled to a wheel axle. Alternatively, the valve 88 can remain open whenever the switch 204 is in an operational position.

In one embodiment, a valve 210 selectively connects the line 86 with a fluid line 212 to the recovery tank 42. This allows the cleaning fluid tank 40 to be emptied of all or most of the residual cleaning liquid at the termination of the cleaning process. The valve 210 may be a solenoid-type valve under the control of a user-operated switch 214.

The cleaning liquid 54 can be heated, prior to application to a floor surface. In the illustrated embodiment, the cleaning liquid is heated within the tank chamber 52, prior to its release into the fluid distribution system 83. The heating elements 74, 76 in this embodiment are resistively heated by a heating current supplied by a 120V or 240V AC supply. The heating element(s) 74, 76 can alternatively be immersion-type heating elements (see FIG. 20). It is to be appreciated that the cleaning liquid may alternatively by heated by a heater which surrounds the tank 40, by a heat exchanger in the fluid line 86, or by other heating methods, such as induction.

For home use, where the extractor may be powered from a duplex outlet by a household power supply typically limited to 15 amps, the heater 70 can have a warm-up mode, in which a high power is used by the heater, and an operating mode, in which a lower power is used. For example, in the warm-up mode, the heater can be powered with about 1500 watts (consuming about 12.5 amps), while in the operating mode, the power consumption of the heater can be limited to a maximum of less than 1000 watts (e.g., a maximum of about 500 watts) (4.2 amps) leaving a larger portion of the available current for powering other components of the extractor. As shown in FIG. 12, the heater 70 may include two taps 222, 224, which are under the control of the control system 200. One tap 222 is connected to the 1500 watts output and the other tap 224 to the 500 watts output. Depending on which tap is selected, either the element 74 (or element 76) or both elements 74, 76, are heated. The extractor may be programmed to automatically enter the warm-up mode when it is switched on.

To reduce the warm-up time of the cleaning liquid, the supply tank 40 may be filled with preheated liquid, such as hot tap water at a temperature of about 60-65° C., or higher. For a two-gallon tank, the hot tap water may be heated by the heater 70 by about 8-20° C. to about 71-85° C. in about three to four minutes. During this warm-up period, pressurization of the tank may also take place, thus the overall warm-up period is only about three minutes. During the operating mode, at 500 watts, one or both the heating element(s) 74, 76 heat the liquid at about 1° C./minute (for two gals.), which serves to offset heat losses from the liquid. The tank walls 44 may be insulated, for example, by providing a double-walled supply tank 40, to minimize heat loss, as an alternative to or in addition to heating during the operating mode.

Figure 13:
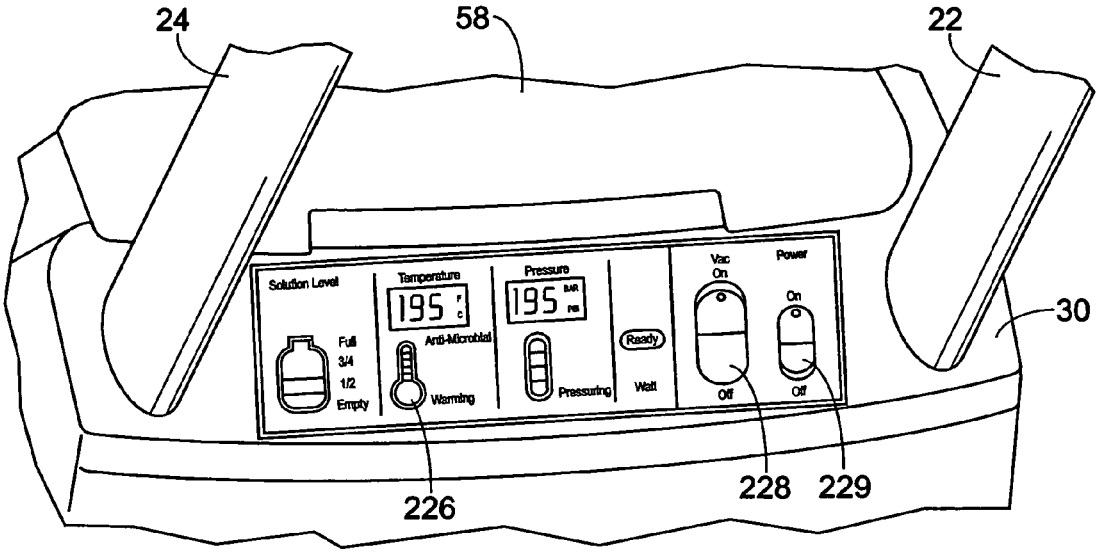
FIG. 13 is an enlarged perspective view of a display panel on the extractor of FIGS. 1 and 11.

During the warm-up period, the control system 200 may disable the release valve 88. This prevents release of cleaning liquid until the warm-up period is complete. Additionally or alternatively, the extractor may include an indicator 226 (FIG. 13), which alerts the operator when the warm-up period is complete and carpet cleaning can begin. The illustrated indicator 226 can be an LED/LCD display panel located on the base housing 30 or handle bar 26, although other locations or visible/audible indicators are also contemplated. FIG. 13 illustrates one embodiment of a display panel 226, which displays cleaning liquid temperature, supply tank pressure, and liquid level as well as providing indicators, which display when the temperature and pressure have reached optimum cleaning conditions. The control system 200 may switch the fan/motor 160 on automatically when the warm up period is complete. Alternatively, the display 226 may show when the cleaning liquid has reached the operating temperature and pressure. At that point, the user may operate a vacuum switch 228 to power the fan/motor 160. A power switch 229 controls power to the extractor.

With reference once again to FIG. 7, optionally, one or more sensors can be employed. These can include a temperature sensor 230, a pressure sensor 232, and/or a liquid level sensor 234. Such sensors can be located within the tank 40 or in communication therewith for monitoring the cleaning liquid temperature, pressure within the tank 40, and/or liquid level in the tank. With reference again to FIG. 12, the control system 200 may shut off or reduce power to one or more of the heating element(s) 74, 76 when the temperature of the liquid exceeds a pre-selected maximum temperature, or the liquid level drops below a pre-determined minimum level. The air pump 64 is controlled by the control system 200 to maintain the pressure in the chamber 52 within a pre-determined acceptable range. The illustrated liquid level sensor 234 (FIG. 7) includes a tube 236, which is connected at both ends with the chamber 52. A float 238 in the tube 236 is detected by a sensing device 239. Sensed temperatures and pressures as well as a solution level may be displayed graphically on the display 226, as illustrated in FIG. 13. In general, the pressure and temperature of the cleaning liquid during a normal cleaning operation is not user selectable, but is pre-selected to provide optimum cleaning efficiency. However, it is also contemplated that the user may be provided with selection switches which allow some control of temperature and/or pressure, between safe operating limits.

In the illustrated embodiment, gas line 66 connects the pressurizing pump 64 with the tank inlet 68. As will be discussed in greater detail below, an alternative to pressurizing the tank 40 can be to employ a liquid pump, for example, in the liquid delivery line 86, which pressurizes the cleaning liquid on its way to the distributor 92. A high pressure gear or piston fluid pump is a suitable pump for pressurizing the cleaning liquid between the tank and the carpet. A pump of this type is described, for example, in U.S. Pat. No. 6,836,928, which is incorporated herein by reference in its entirety. In yet another embodiment, which will be discussed in greater detail below, a removable fluid tank, which need not be pressurized, is removably connected with a fixed pressurized tank.

With reference once more to FIG. 10, in one embodiment, a collection vessel 240 in the shape of a conical funnel surrounds the fill tube 48 to direct cleaning fluid into the supply tank 40. The funnel 240 may incorporate an overflow feature in the form of a tube which defines a passage 242 through which excess cleaning fluid, which overflows tank 40 if too much is supplied, drains from a lower end of the funnel 240 into the recovery tank 42. In this embodiment, the recovery tank has an opening 244 which mates with a lower end of the passage 242 when the recovery tank is installed on the extractor. The opening 244 may be open during operation of the extractor. In the illustrated embodiment, the lid 58 engages a locking member 246 when the lid is closed. The engagement causes a moveable closure member 248 to move upward, as illustrated by arrow B, to a position in which it allows access to the recovery tank opening 244. When the lid 58 is opened (as illustrated in phantom), the locking member 246 automatically moves the closure member 248 downward, thereby preventing access from the passage to the recovery tank.

The speed of the extractor 10 across the floor may be controlled to provide optimum cleaning efficiency and recovery. In one embodiment, a speed restrictor, such as a gear solenoid 249 (FIG. 12) can limit the speed of the extractor in the carpet cleaning (rearward) direction to a maximum speed. The gear solenoid 249 is actuated when a rearward (pulling) motion is commenced. The friction mechanism provides an increasing resistance to travel as the speed increases, making it difficult for the operator to pull the extractor rearward too quickly. The operator is thus conditioned to maintain a maximum speed of about 0.3-0.35 cm/sec (0.6-0.7 ft/min). Alternatively, the wheels can be driven by a motor (not shown) at an optimal speed.

As illustrated schematically in FIG. 12, an above-floor distributor 254, such as spray nozzles, on a hand tool can be fluidly connected with the supply line 86. To this end, a two-hose conduit includes a suitable liquid delivery line 256. The conduit also includes a suction inlet line 258, which fluidly connects a hand suction nozzle 257 with the recovery tank 42.

Figure 14:
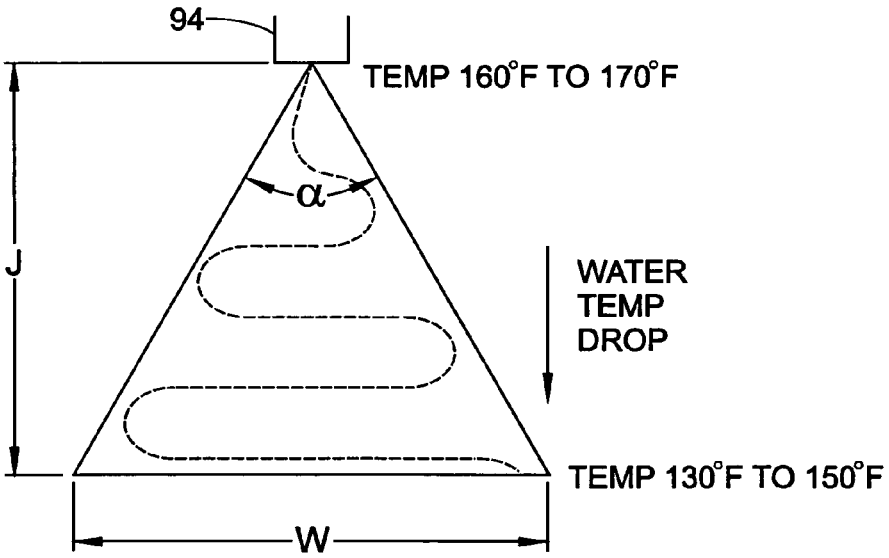
FIG. 14 is a schematic view of a spray pattern from the spray nozzle of FIG. 8.
Figure 15:
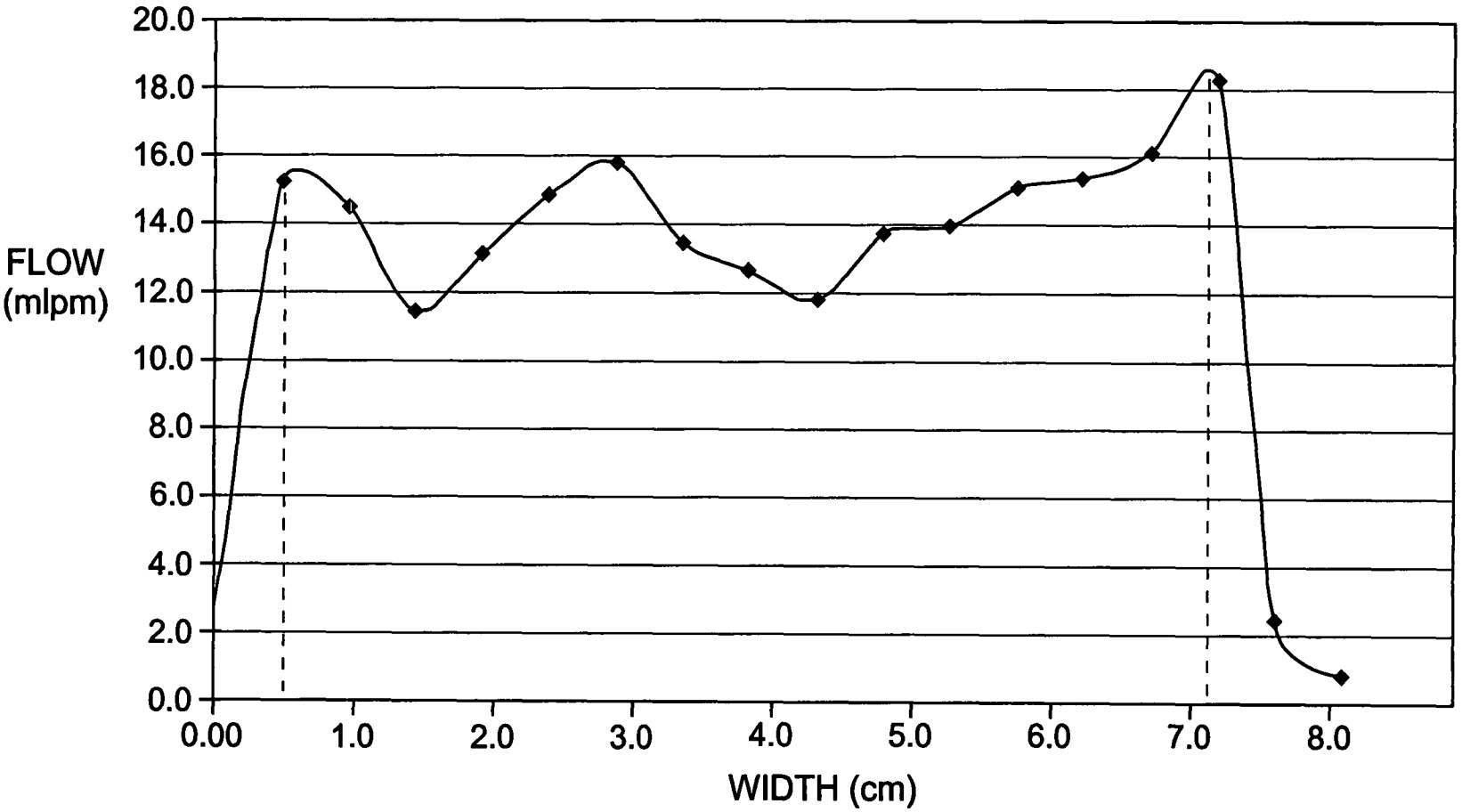
FIG. 15 is a plot of flow vs. width of a spray jet from the spray nozzle of FIG. 8.

With reference now to FIG. 14, the spray from the spray nozzles 94 may have an S-shaped pattern with a spray angle $\alpha$ of about 60-80° (e.g., about 65-75°), and in one embodiment, about 71°. In one embodiment, the nozzles 94 are located a height j of about 2.0" (about 5 cm) from the floor surface, to provide a coverage width w of about 2.75" (about 7 cm). The S-shaped spray pattern provides relatively even distribution across the width of coverage. As illustrated in FIG. 15, there is a width of about 6.3 cm in which the standard deviation in flow rate is less than 2 ml/min. The nozzle outputs may be overlapped slightly so that a relatively even distribution is achieved. The S-shaped pattern provides additional agitation when the liquid cleaning solution strikes the floor. A suitable nozzle of this type is obtainable from Bowles Fluidic Corporation, Columbia, Md. 21045.

The temperature of the water drops when sprayed and prior to reaching the carpet surface. For example, the sprayed water may drop in temperature about 2-4° C./cm as it falls from the nozzles 94 to the carpet. Thus, for a nozzle about 2.5-5 cm above the carpet, about a 10-17° C. temperature drop may be expected. By heating the water to a temperature of about 80° C. or higher, the cleaning liquid has a temperature of about 54-70° C. when it reaches the carpet. This provides an effective temperature for the cleaning fluid. In one embodiment, the temperature of the water is selected to provide a temperature at the floor of greater than 66° C., to provide an anti-microbial and/or disinfection temperature level.

The cleaning liquid tank 40 is filled, prior to use, with a cleaning liquid 54, such as tap water, into which can be mixed a concentrated cleaning solution comprising detergents to aid in the cleaning of the carpet. To minimize corrosion of the heating plate 72 and/or heating elements 74, 76, the cleaning liquid may include a chelating agent for removal of water hardness salts, such as magnesium and calcium from the water. Clean water, on its own, may be used for cleaning and/or rinsing the floor at the temperatures and pressures contemplated herein. In an alternative embodiment, the cleaning solution is mixed with heated water downstream of the supply tank, as described in further detail below.

The illustrated extractor 10 operates efficiently without an agitator. However, it is also contemplated that the base may be provided with a motor-driven, rotating brush-roll, or other suitable known types of agitators (not shown), such as one or more brushes that rotate around a vertical axis. The one or more agitators can be located in a spray nozzle cavity 104, for assisting the introduction of the cleaning liquid to the carpet. Of course, the agitator(s) could be located at any desired point between the spray nozzle and the vacuum nozzle.

To operate the extractor, the tank 40 is filled with clean, heated tap water. A concentrated cleaning solution can be added, using the inverted cap 56 as a measure. The cap is attached and the extractor switched on. The control system 200 may sense that the cap 56 is in place before beginning pressurization and heating. For example, the cap may complete an electrical circuit, or other means may be provided for ensuring that the tank is sealed (see FIG. 4). The end of a warm-up period, of about three minutes, is signaled to the operator by the illumination of the indicator 226. For example "warming" and "pressurizing" indicia may change to "ready." The operator maneuvers the extractor across the floor surface to be cleaned. During pulling (rearward) motions, cleaning liquid is delivered to the floor surface when the switch 204 is actuated, and suctioned up shortly thereafter by the suction nozzle 112.

When the recovered liquid in the recovery tank 42 reaches a predetermined level, the float 174 closes off the standpipe. Now, the recovery tank can be removed from the base, for example, with the aid of a carrying handle 260 (FIG. 1) mounted to an upper end of the tank. The recovery tank 42 is emptied via the spout 176 (FIG. 10). At this time, the operator may elect to refill the cleaning liquid tank 42 and a further warm-up period commences.

For above-floor cleaning, the hand tool sprayer 254 and hand suction nozzle 257 are fluidly connected with the supply tank 40 and recovery tank 42, respectively.

FIG. 16 shows an estimated power budget for the extractor of FIG. 1 in warm-up and operating modes. It can be seen that during warm-up, power is used primarily by the pressure source 64 and heater 70. Once the warm-up period is over, the power is consumed by the fan motor 160 as well as by the pressure source 64 and heater 70.

With reference now to FIGS. 17-21, a second embodiment of a floor cleaning device, according to the present invention and in the form of a carpet extractor 310, is there illustrated. The extractor 310 is similar to the extractor 10, except as otherwise noted. It will be appreciated that features of the extractor 310 may be incorporated into the extractor 10, or vice versa. The extractor 310 includes a base 312, wheels 316, and a directing handle 318. Optionally, a cross member (not shown), similar to cross member 38, can connect arms 322, 324 of the handle 318. In this embodiment, arms 322, 324 may include upper and lower telescoping portions, respectively, which telescope one into the other to vary the height of the bar 326. Alternatively, arms 322, 324 may be retracted into the base, as illustrated for the embodiment of FIG. 2.

Figure 20:
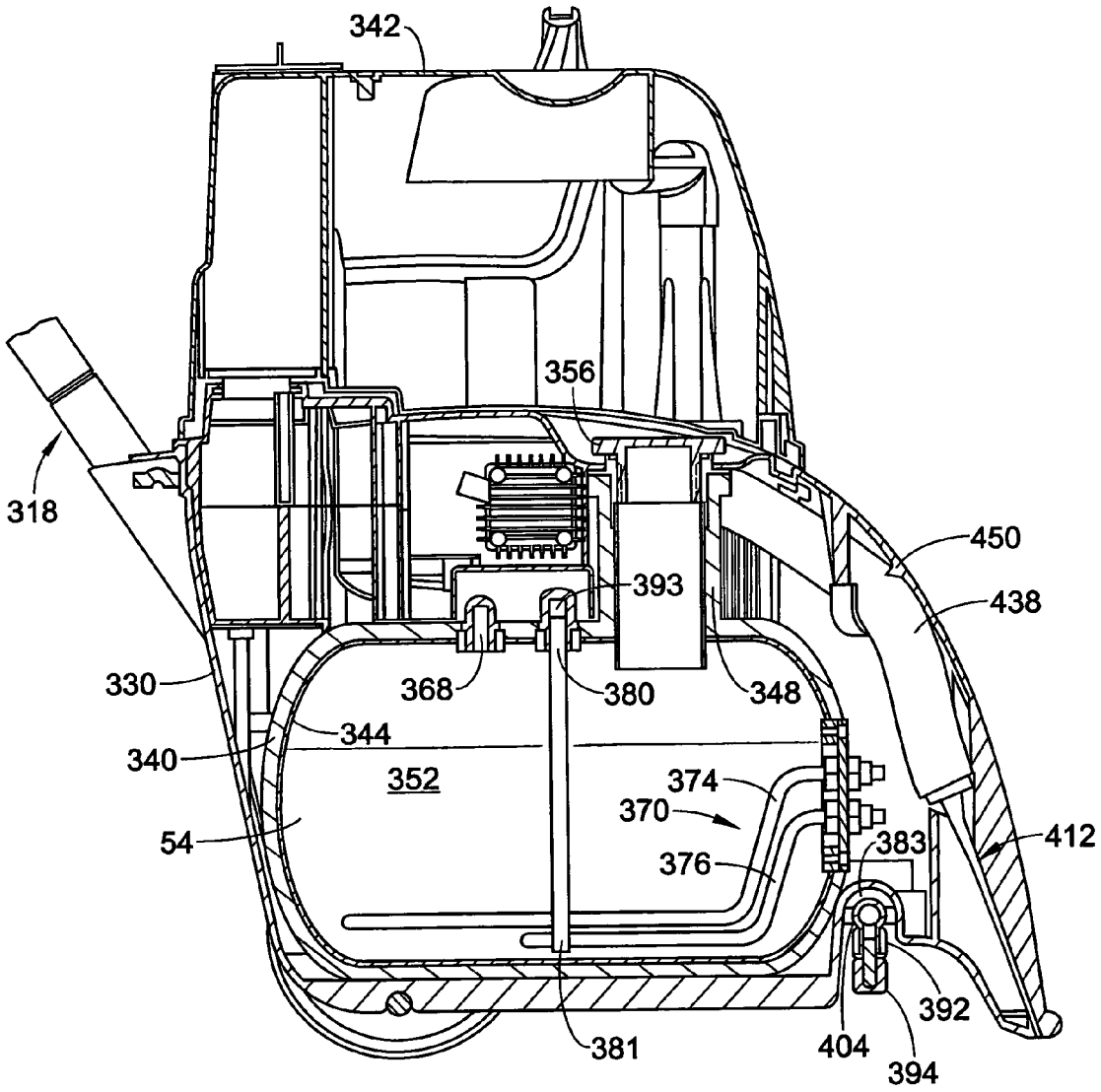
FIG. 20 is a side sectional view of the extractor of FIG. 17.
Figure 21:
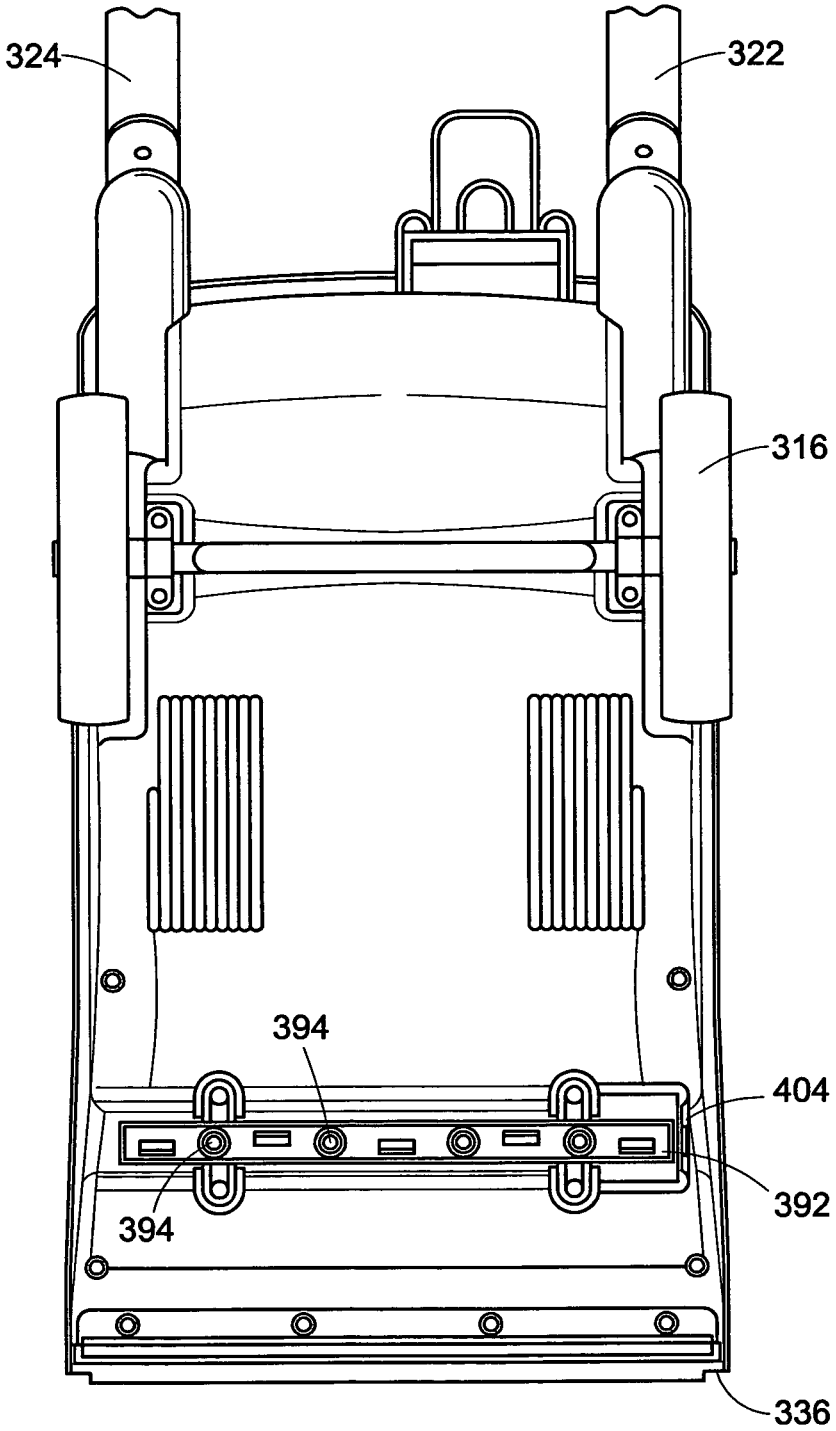
FIG. 21 is a bottom plan view of the extractor of FIG. 17.

In this embodiment, a cleaning liquid supply tank 340 (FIG. 20) is located below a cleaning liquid recovery tank 342. The tanks 340, 342 are generally arranged such that the weight of the tanks and the cleaning liquid contained therein is centered over the wheel axis or closely adjacent thereto. This reduces the physical effort of cleaning for an operator. As illustrated in FIG. 20, the supply tank 340 is oriented with its longitudinal axis arranged generally horizontally, rather than vertically, as for the embodiment of FIG. 2. As a consequence, the fill tube 348 extends from a side wall 344 of the tank. The pressure withstanding cap 356 is covered, during operation, by the recovery tank 342, thereby preventing a user from accidentally releasing heated liquid under pressure.

Figure 19:
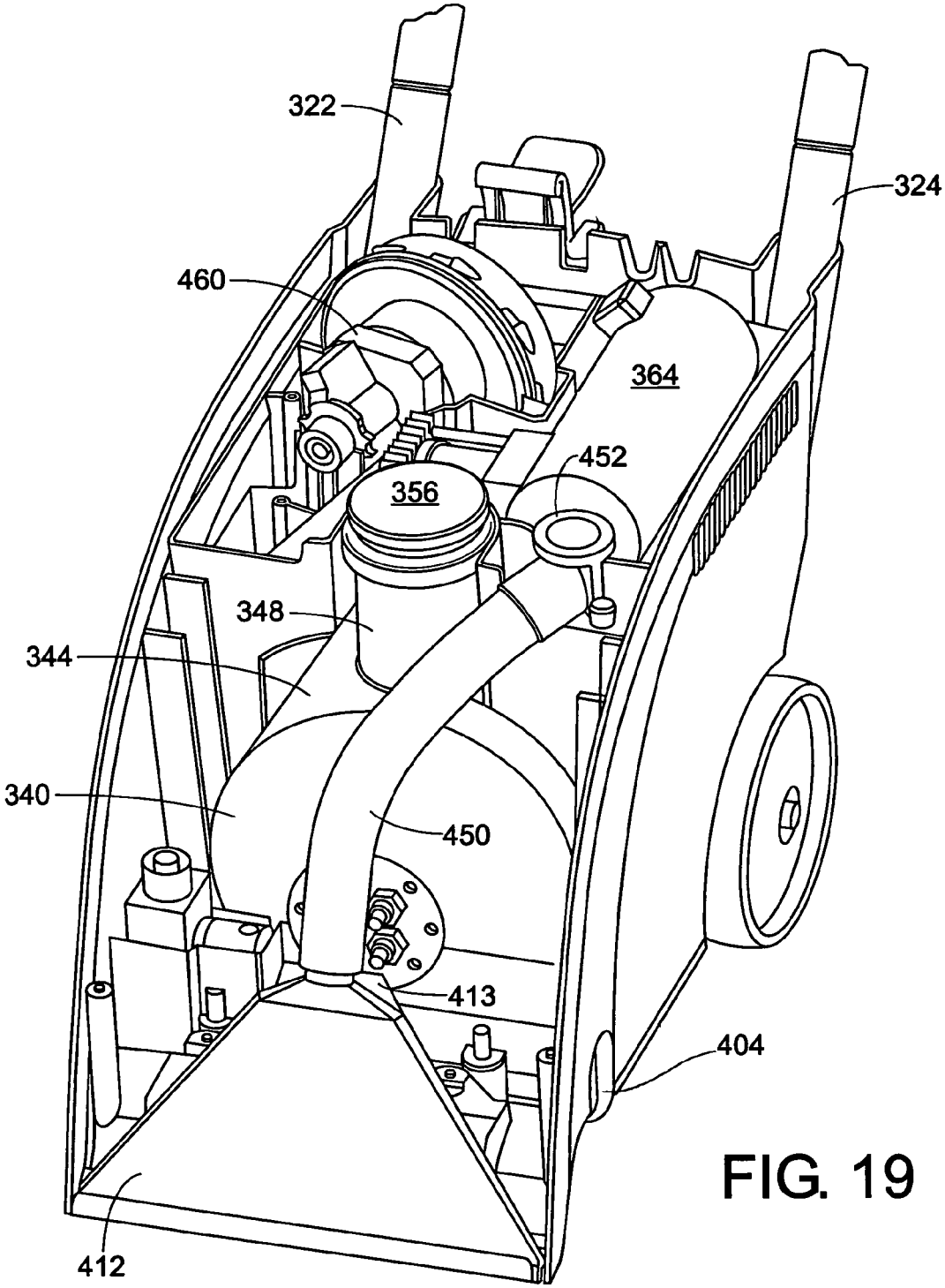
FIG. 19 is a perspective view of the base of the carpet extractor of FIG. 17, partially cut away to show the interior components of the base.

With reference to FIG. 19, a pressure source 364 is connected with the supply tank 340 for pressurizing the tank. The pressurized air (or other suitable pressurizing gas) enters the tank via a fill port 368 (FIG. 20) at an upper end of the supply tank 340. The liquid in the supply tank 340 is heated by a heater 370, which in the illustrated embodiment, includes immersion-type heating elements 374, 376. These may be operated separately or together, to provide different heating rates for warm-up and operational modes, as for the embodiments of FIGS. 4-7.

A liquid outlet 380 in the form of a pipe is arranged vertically within the supply tank. It has an inlet 381 at its lower end which is positioned in the cleaning liquid, close to a lower end of the tank 340. The pipe 380 is fluidly connected with a liquid distributor 392 (FIG. 21), through which the cleaning liquid is distributed on to the floor. Cleaning liquid enters the pipe 380 and is forced upward, under pressure.

The fluid delivery system and fluid recovery system of the extractor 310 may be similar to that for extractor 10, shown in FIG. 12.

With reference now to FIG. 20, the liquid distribution system 383 in the illustrated embodiment includes a fluid line (not shown), which is connected with an outlet end 393 of the standpipe 380 of tank 40 for delivering cleaning liquid to spray nozzles 394.

A cleaning liquid 354 can be heated, prior to application to a floor surface. In the illustrated embodiment, the cleaning liquid is heated within the tank chamber 352, prior to its release into the fluid distribution system 383. The heating elements 374, 376 in this embodiment are immersion-type heating elements. They can be mounted within the tank chamber 352 and resistively heated by a heating current supplied by a 120V or 240V AC supply as for the embodiment of FIG. 12.

Figure 17:
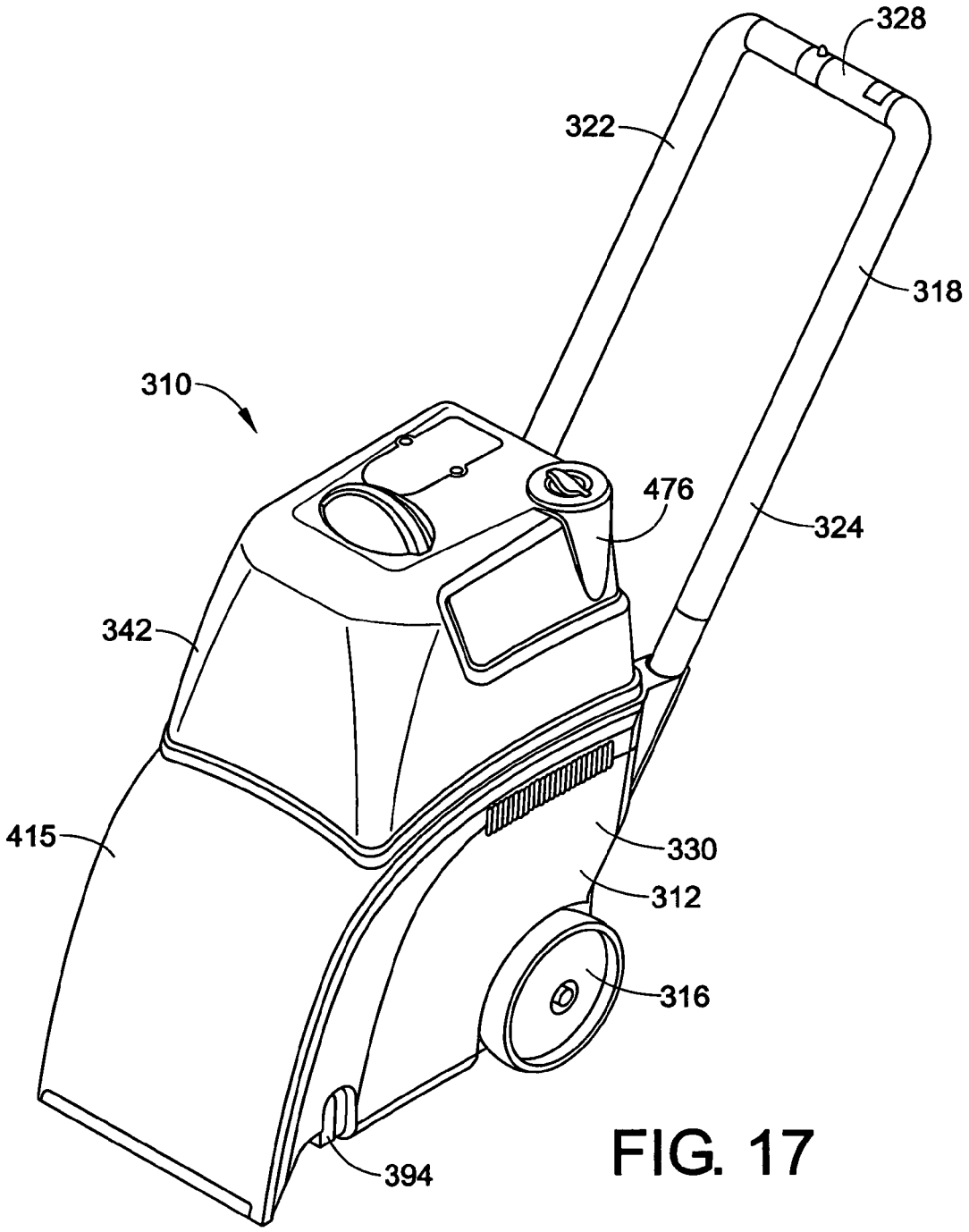
FIG. 17 is a perspective view of an alternative embodiment of an extractor according to the present invention.
Figure 18:
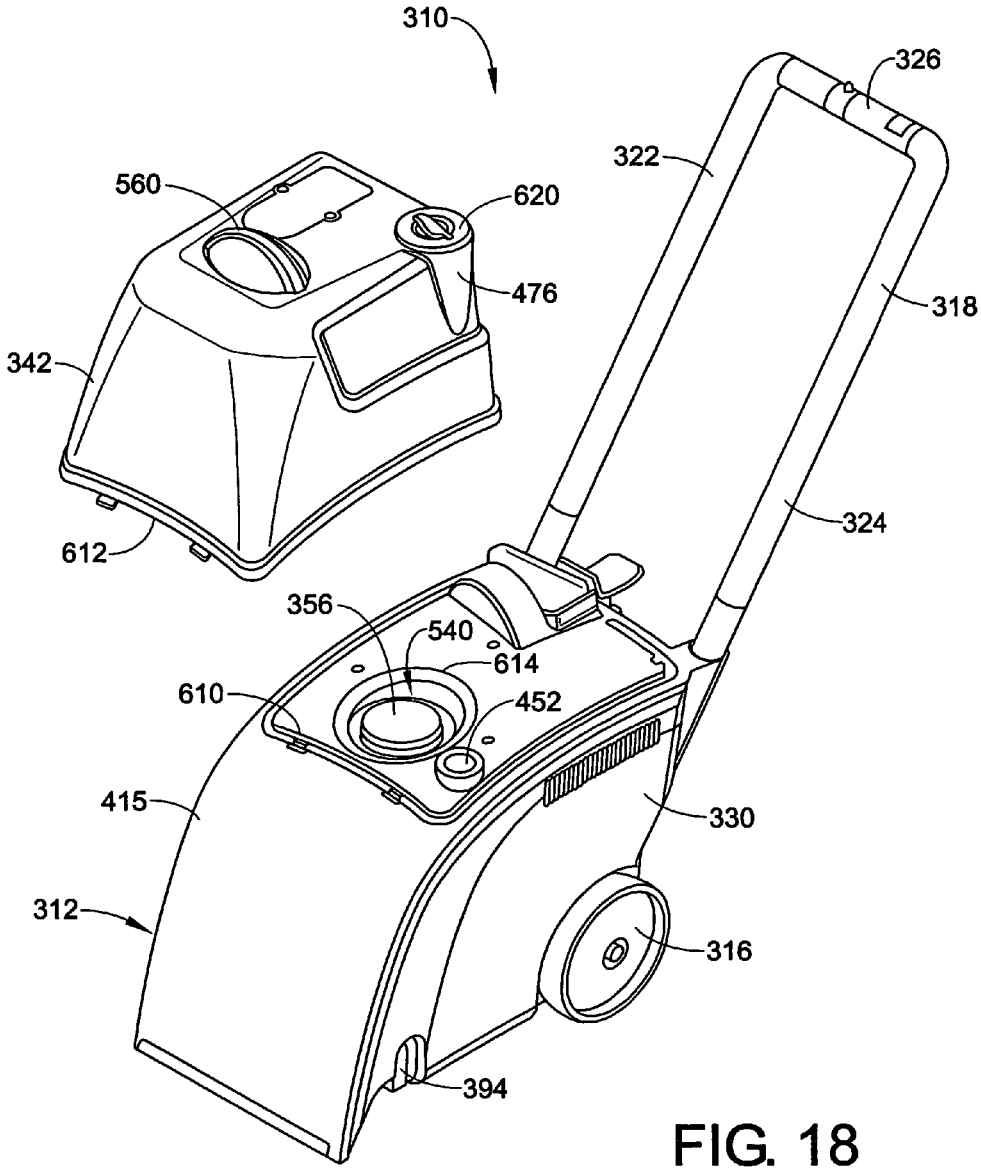
FIG. 18 is a perspective view of the carpet extractor of FIG. 17 with the recovery tank shown lifted off the base.

With continued reference to FIG. 20, the cleaning fluid is withdrawn from the carpet into the recovery tank through a suction nozzle 412 located at the forward end 436 of the base. With reference now to FIG. 18, the illustrated suction nozzle 412 can be carried by a mounting plate 413, which is rigidly mounted to a lower end of the base. As shown in FIG. 17, the suction nozzle 412 is covered, during floor cleaning, by a front panel 415 of the base housing 330. The panel 415 can extend upward and rearward to the lower end of the handle 18 (FIG. 18). In other embodiments, the suction nozzle 412 may be otherwise carried by the base. As shown in FIG. 18, the front panel 415 defines a groove 610 on its upward facing surface, which receives a rim 612 of the lower end of the recovery tank 342 therein. The panel 415 defines an aperture 614 through which the pressure cap is accessible when the recovery tank is removed.

As shown in FIG. 20, the suction nozzle 412 is fluidly connected to the recovery tank 342 by a flexible suction hose 450. The suction hose has a connector fitting 452 (FIG. 18) at its distal end which extends through the front panel 415. The connector fitting 452 is configured for selective interconnection with a corresponding connector on the lower end of the recovery tank in a similar manner to that illustrated in FIG. 4, through which the recovered fluid enters the recovery tank 342. The recovery tank emptying outlet 476 is closed, during suctioning, by a removable cap 620 (FIG. 18).

As illustrated in FIG. 19, a suction source 460, such as a fan/motor, is fluidly connected with the recovery tank 342 and applies suction to the nozzle 412 and/or the recovery tank to draw working air and recovered cleaning liquid from the carpet into the recovery tank via the passage 438. The fan/motor may be supported within the housing 330, on the base, or located elsewhere on the extractor.

The carpet extractor 10, 310 has an efficiency, which is comparable with that of many of the larger, commercial carpet extractors, while being readily portable and able to operate at current loadings of less than 15 amps.

Figure 22:
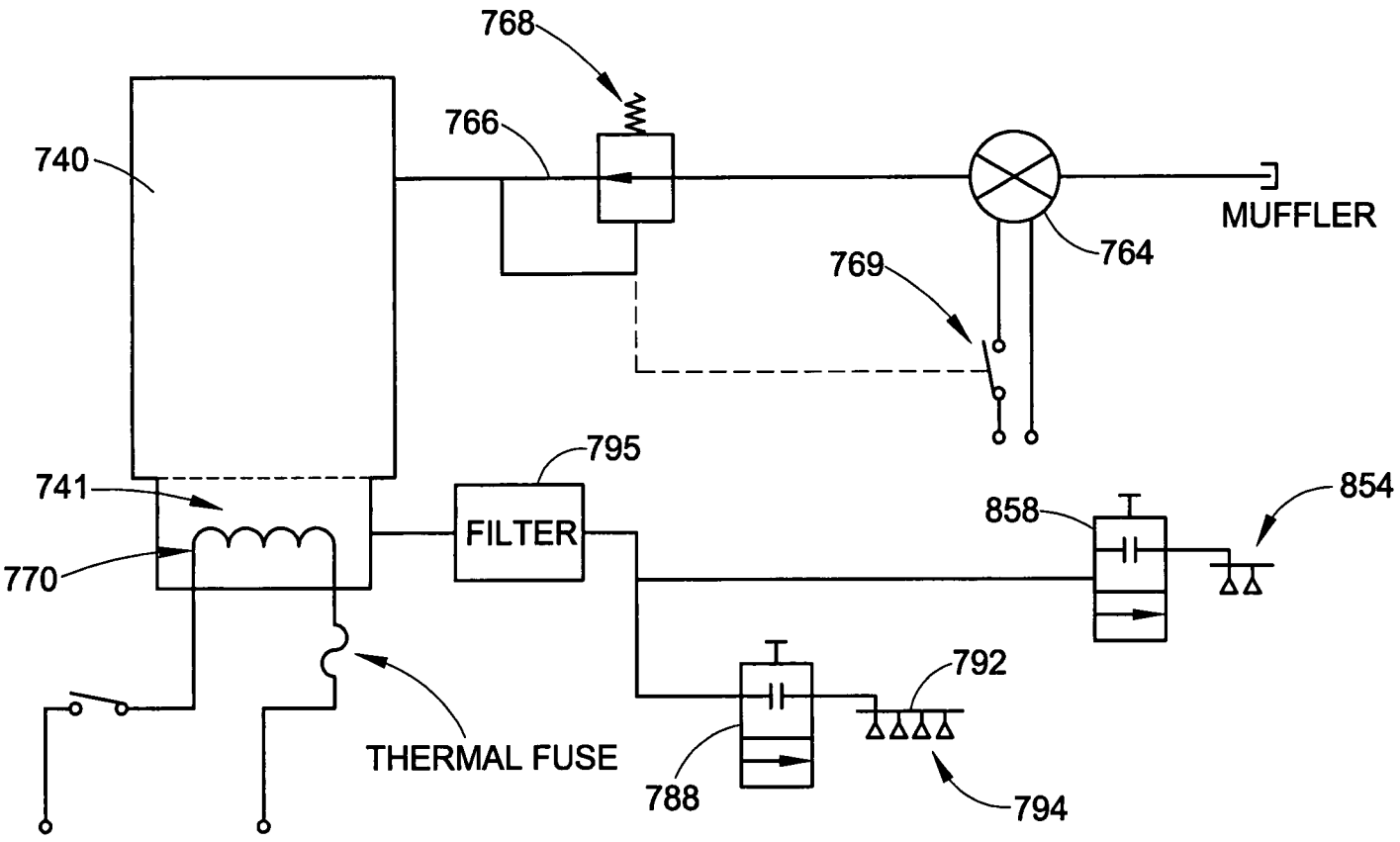
FIG. 22 is a schematic view of a liquid delivery system and recovery system of a carpet extractor according to a fourth exemplary embodiment of the present invention.

FIG. 22 shows an alternative embodiment of a fluid system for an extractor according to the present invention. This embodiment is similarly configured to that of FIG. 12, except as otherwise noted. In this embodiment, a removable liquid supply tank 740 is releasably connected to an on-board supply tank 741 by known quick connect connectors. The on-board tank 741 may be of smaller size than the removable tank (e.g., about 1-4 liters for the tank 741; about 6-10 liters for the removable tank 740). In this embodiment, the non-removable on-board tank has a heater 770 embedded therein similar to heater 370 or heater 70. The removable tank 740 is pressurized by a pressure source 764, similar to pressure source 64, which also pressurizes the small on-board tank 741. In this embodiment, the tank 740 may be hooked up to a gas line 766 during the installation of the tank 740 on the extractor base. A regulator 768 in line 766 actuates a cut-off switch 769 for the pump 764. As with the other embodiments, heated, pressurized cleaning fluid is delivered from the tank 741 to spray nozzles 794 of a distributor 792 under the control of a valve 788 or to nozzles 854 of an above floor tool under the control of a valve 858. The cleaning fluid may be filtered by a filter 795. The fluid recovery system, which is not illustrated in FIG. 22, may be similar to the fluid recovery system 110 of FIG. 12.

Figure 23:
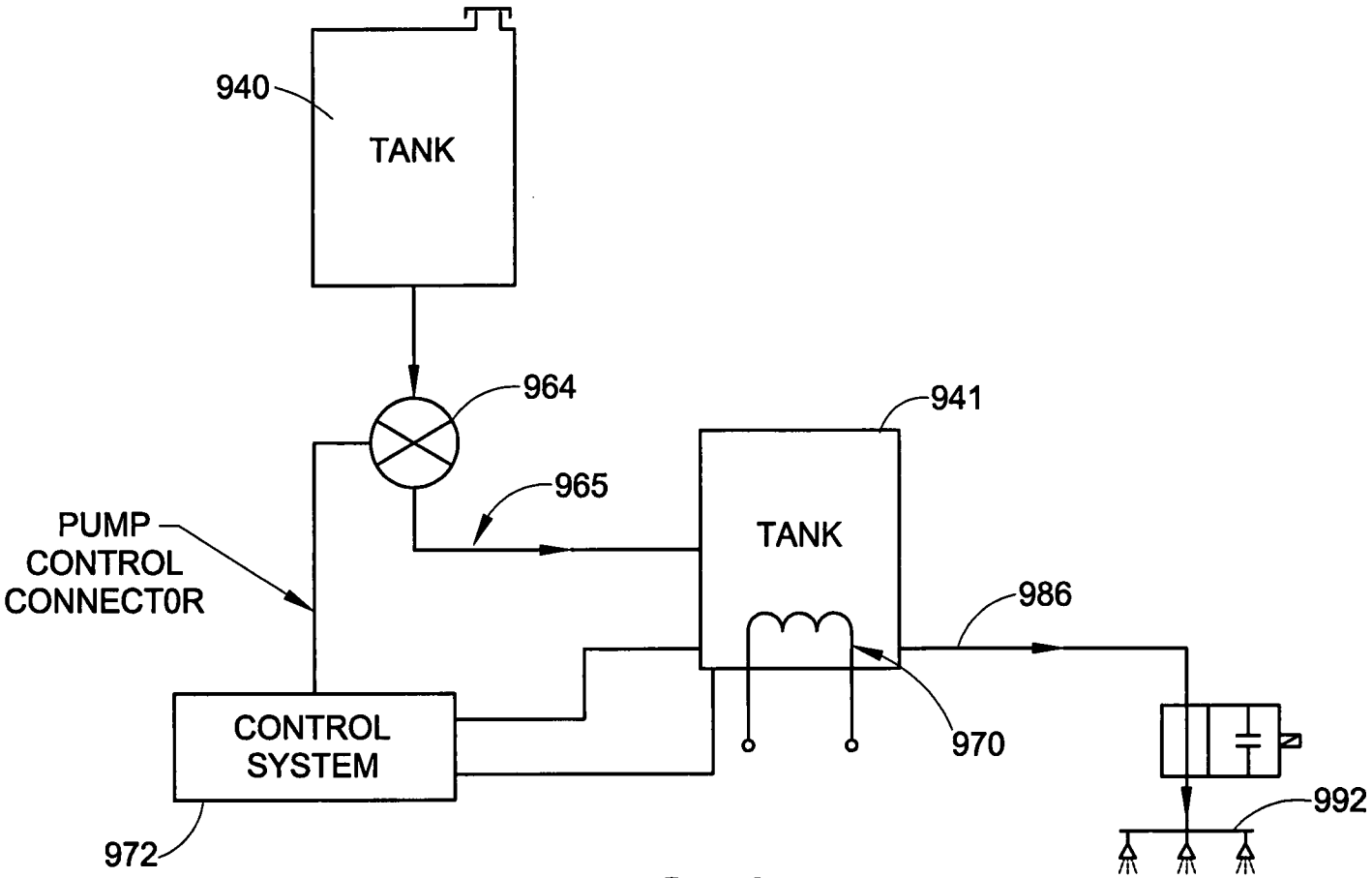
FIG. 23 is a schematic view of a liquid delivery system and recovery system of a carpet extractor according to a fifth exemplary embodiment of the present invention; and, FIG. 24 is a schematic view of a liquid delivery system and recovery system according to a sixth exemplary embodiment of the present invention.

FIG. 23 shows another alternative embodiment of a fluid system for an extractor according to the present invention. This system can be similar to that of FIG. 11, except as otherwise noted. In this embodiment, a removable liquid supply tank 940 is releasably fluidly connected to an on-board tank 941. The on-board tank 941 may be similar to tank 741 and of smaller size than the removable tank. The on-board tank 941 can include a heater 970 similar to heater 70 or 370. The heater may be under the control of a control system 972 analogous to control system 200. The removable tank 940 may be open to the atmosphere and unpressurized. A pump 964 is located in a fluid line 965 which interconnects the tank 940 and tank 941 when the tank 940 is mounted on the base. Alternatively, the pump 964 can be located in a fluid line 986, which interconnects the tank 941 and distributor 992. A high pressure gear or piston fluid pump can serve as pump 964, for pressurizing the cleaning liquid between the tank 940 and the carpet. A pump of this type is described, for example, in U.S. Pat. No. 6,836,928, which is incorporated herein by reference, in its entirety. As with other embodiments, a hand tool (not shown) may be selectively connected with fluid line 986. The fluid recovery system, which is not illustrated in FIG. 23, may be similar to the fluid recovery system 110 of FIG. 12.

Figure 24:
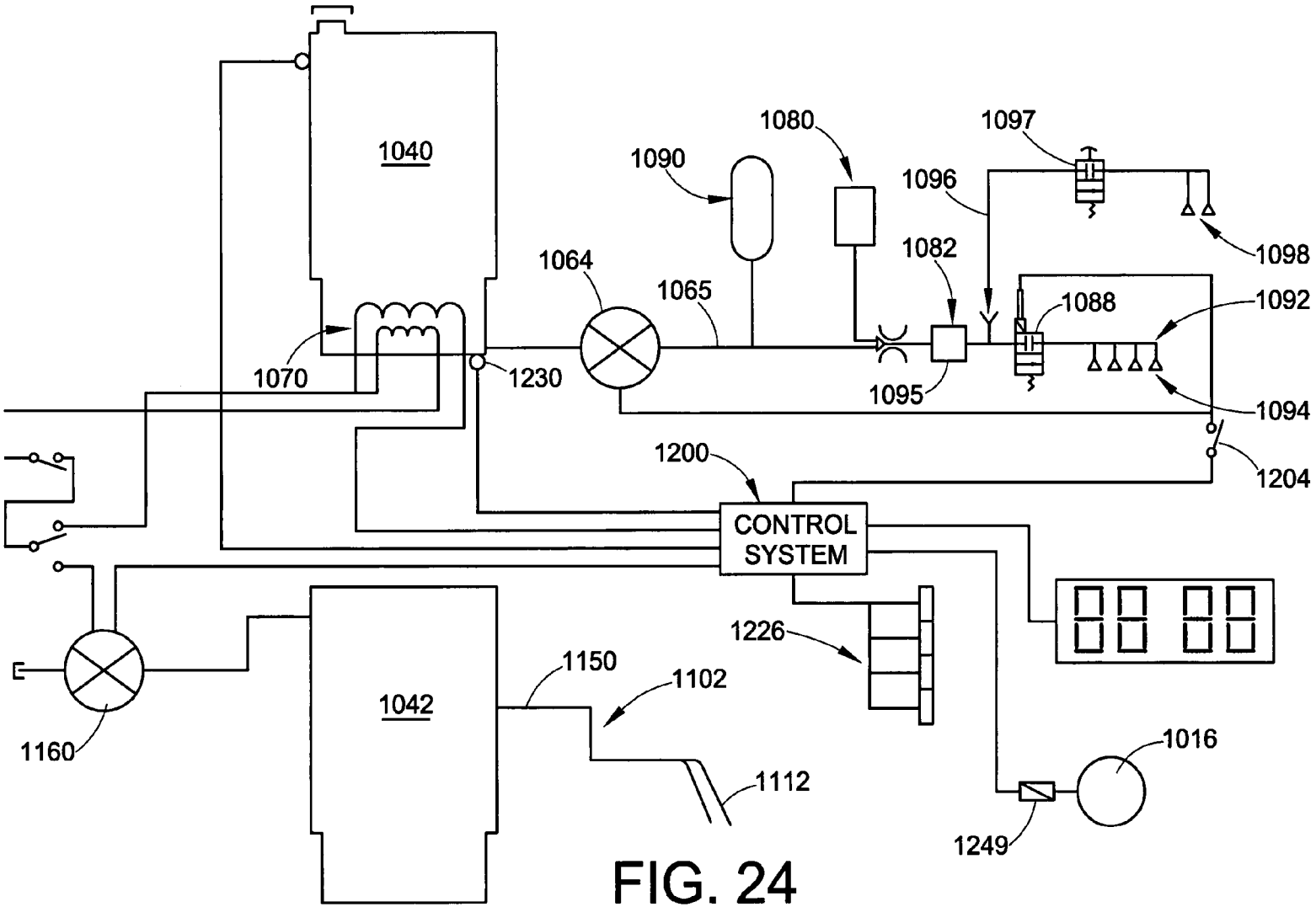

FIG. 24 shows another alternative embodiment of a fluid system for an extractor according to the present invention. This system can be similar to that of FIG. 12, except as otherwise noted. In this embodiment, a liquid supply tank 1040 is attached to the base of the extractor. However, it is also contemplated that the tank 1040 may be removable, with electrical connections for providing power to a heater 1070 when the tank is installed on the extractor base. Water or other cleaning liquid in the tank 1040 is heated by the heater 1070. The heater may be analogous to the heater of any one of FIGS. 4, 6, and 7. The supply tank 1040 may be open to the atmosphere and un-pressurized. In this embodiment, the liquid is not pressurized within the supply tank 1040, but is pressurized downstream of the supply tank. Specifically, a high pressure pump 1064 may be located in a fluid line 1065, intermediate the tank 1040 and nozzles 1094. The pump 1064 may be analogous to the pump 964 of FIG. 23. As with the embodiment of FIG. 12, a second supply tank 1080, similar to tank 180, contains cleaning concentrate, which is selectively fed into the fluid line 1065. In this embodiment, the concentrate is introduced at a venturi 1082, which is located in line 1065 downstream of the pump 1064. The supply tank 1080 may be of smaller size than the main supply tank 1040.

In one embodiment, an accumulator 1090 in line 1065 serves as a temporary reservoir of heated, pressurized cleaning fluid. Since the volume of liquid pressurized by the pump 1064 in line 1065 is relatively small, the accumulator provides an additional volume of pressurized fluid. The accumulator 1090 assists in maintaining the pressure of the cleaning liquid in the line when the demand is high. In cases where a large amount of cleaning fluid is released from the supply tank 1040 in a relatively short period of time, the pump 1064 may be unable to keep up. Pressurized, heated cleaning liquid is stored temporarily in the accumulator 1090, which helps to maintain the pressure at the spray nozzles 1094. Additionally, by limiting the amount of cleaning fluid sprayed in the forward (non-cleaning) direction, excessive pressure drops can be avoided. As will be appreciated, such an accumulator 1090 may be employed with the other embodiments disclosed herein, such as those of FIGS. 12, 22, and 23.

In FIG. 24, the cleaning concentrate tank 1080, the accumulator 1090, and also a filter 1095 are located downstream of the pump 1064. However, other arrangements are contemplated. For example, the pump 1064 may be located in the fluid line 1065 downstream of the venturi 1082.

As shown in FIG. 24, a cleaning fluid line 1096 for delivering water mixed with cleaning fluid concentrate to spray nozzles 1098 of an above-floor cleaning tool may be selectively connected with the line 1065 downstream of the pump 1064, the concentrate tank 1080, the venture 1082, and the filter 1095. Of course, it could connect to the line 1065 at another location.

A fluid recovery system 1102 may be similar to the fluid recovery system 110 of FIG. 12. For example, a recovery tank 1042 is in fluid communication with a suction nozzle 1112 via a suction passage 1150 and also with a suction source 1160.

Although not illustrated, a suction nozzle of the above-floor tool may be selectively connected with the line 1150 as for the suction nozzle 257 shown in FIG. 12.

A control system 1200 controls the heater 1070 and the suction source 1160 and communicates temperature information from a sensor 1230 to a display 1226, analogous to display 226. The control system 1200 also communicates with a valve 1088 in line 1065, to actuate the spray nozzles 1094 when the circuit is completed by a user-operated switch 1204, analogous to switch 204. A similar valve 1097 can be provided in line 1096 to control a flow of cleaning fluid to the above-floor cleaning tool nozzles 1098. In this embodiment, there is no need for the control system to sense the pressure in the tank 1040. However, it is contemplated that the control system 1200 may be linked to a temperature sensor 1230 and a volume sensor 1231. Also, a pressure transducer or other pressure sensor (not shown), which senses the pressure in line 1065 can be provided.

The warm-up period, in this embodiment, is the time for heating the water in the tank 1040 to the desired temperature. Once the desired temperature is reached, the control system 1200 displays the end of the warm-up period on the display 1226, and the user may then commence carpet cleaning. The pump 1064 may be actuated once the warm-up period is complete, and heated liquid begins to flow through the line 1065.

The invention has been described with reference to several preferred embodiments. Obviously, modifications and alterations will occur to others upon a reading and understanding of this specification. It is intended to include all such modifications and alterations insofar as they come within the scope of the appended claims or the equivalents thereof.

We claim:

1. A floor cleaning device comprising:

a base;

a cleaning fluid supply tank carried by the base;

a source of pressure communicating with the cleaning fluid supply tank that pressurizes a cleaning fluid held in the cleaning fluid supply tank to a pressure above atmospheric pressure;

a fluid delivery system which delivers pressurized cleaning fluid from the cleaning fluid supply tank to a surface to be cleaned;

a heater which heats the cleaning fluid before it exits said fluid delivery system, the heater operating at a first power level in a warm-up phase and at a second power level, lower than the first power level, in an operational mode;

a suction source supported by the base and separate from the source of pressure; and a control system which controls delivery of power to the suction source and the heater, wherein in the warm-up phase, the control system controls delivery of power to the pressure source for pressurizing the cleaning fluid supply tank.

2. The floor cleaning device of claim 1, further comprising: a suction nozzle that fluidly communicates with the suction source, the suction nozzle being supported by the base.

3. The floor cleaning device of claim 2, further comprising a recovery tank, carried by the base, for collecting the dirty cleaning fluid, the recovery tank being in fluid communication with the suction nozzle and the suction source.

4. The floor cleaning device of claim 2, wherein the suction nozzle includes a front plate and a rear plate, longitudinally spaced from the front plate, the front plate defining an edge, the rear plate defining a lip.

5. The floor cleaning device of claim 4, wherein the suction nozzle further includes a flange extending forwardly of the front plate, the flange defining a sliding surface which slides on the carpet at a height above the edge of the front plate.

6. The floor cleaning device of claim 1, further comprising a directing handle for directing the floor cleaning device across the surface.

7. The floor cleaning device of claim 6, wherein the directing handle is selectively extensible and retractable.

8. The floor cleaning device of claim 1, wherein the source of pressure includes an air pump that pressurizes air located in the tank above the cleaning fluid to a pressure of at least 3.5 $Kg/cm^2$.

9. The floor cleaning device of claim 1, wherein the heater heats the cleaning fluid in the fluid supply tank.

10. The floor cleaning device of claim 1, wherein the heater includes at least one of a heating element mounted to a wall of the cleaning fluid tank and an immersion heater located within the cleaning fluid tank.

11. The floor cleaning device of claim 1, further including a valve which selectively restricts fluid flow from the cleaning fluid supply tank to the fluid delivery system, wherein the fluid delivery system includes a distributor.

12. The floor cleaning device of claim 11, wherein when the floor cleaning device travels in a first direction of travel the valve permits cleaning fluid to flow to the distributor, and when the floor cleaning device travels in a second direction of travel the valve restricts cleaning fluid.

13. The floor cleaning device of claim 1, further including a travel limiter which limits speed of travel of the floor cleaning device in a cleaning direction.

14. The floor cleaning device of claim 1, further comprising a second cleaning fluid supply tank, the second cleaning fluid supply tank being carried by the base for selective fluid connection with the first cleaning fluid supply tank.

15. The floor cleaning device of claim 1, wherein the fluid delivery system includes at least one spray nozzle, the at least one spray nozzle having an s-shaped spray pattern.

16. The floor cleaning device of claim 1, wherein the fluid delivery system comprises a distributor and a plurality of nozzles, which are selectively removable from said distributor.

17. The floor cleaning device of claim 1, further comprising a collection vessel which collects overflow cleaning fluid from an opening to the supply tank, the collection vessel being selectively connected with the recovery tank for draining the overflow cleaning fluid into the recovery tank.

18. The floor cleaning device of claim 1, wherein the source of pressure is an air pump configured to supply pressurized air to the cleaning fluid supply tank.

19. The floor cleaning device of claim 1, wherein the source of pressure is an air compressor configured to supply pressurized air to the cleaning fluid supply tank.

* * * * *